US009506480B2

(12) United States Patent
Hiraku et al.

(10) Patent No.: US 9,506,480 B2
(45) Date of Patent: Nov. 29, 2016

(54) APPARATUS FOR DRIVING WORK MACHINE

(71) Applicant: Hitachi Construction Machinery Co., Ltd., Bunkyo-ku, Tokyo (JP)

(72) Inventors: Kenji Hiraku, Tsuchiura (JP); Akinori Isii, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/773,815

(22) PCT Filed: Apr. 2, 2014

(86) PCT No.: PCT/JP2014/059748

§ 371 (c)(1),
(2) Date: Sep. 9, 2015

(87) PCT Pub. No.: WO2014/168058

PCT Pub. Date: Oct. 16, 2014

(65) Prior Publication Data

US 2016/0025113 A1 Jan. 28, 2016

(30) Foreign Application Priority Data

Apr. 11, 2013 (JP) ..... 2013-083130

(51) Int. Cl.

| | |
|---|---|
| ***F15B 11/17*** | (2006.01) |
| ***E02F 9/22*** | (2006.01) |
| ***F04B 1/26*** | (2006.01) |
| ***F04B 49/06*** | (2006.01) |
| ***F15B 13/06*** | (2006.01) |

(52) U.S. Cl.

CPC ..... *F15B 11/17* (2013.01); *E02F 9/2235* (2013.01); *E02F 9/2289* (2013.01); (Continued)

(58) Field of Classification Search

CPC .. F15B 11/17; F15B 13/06; F15B 2211/405; F15B 2211/6652; F15B 2211/20561; F15B 2211/6346; F15B 2211/20569; F15B 2211/20576; F15B 2211/20546; F04B 1/26; F04B 49/065; E02F 9/2296; E02F 9/2235; E02F 9/2289; E02F 9/2292

See application file for complete search history.

(56) References Cited

U.S. PATENT DOCUMENTS

| | | | |
|---|---|---|---|
| 4,369,625 | A | 1/1983 | Izumi et al. |
| 4,537,029 | A | 8/1985 | Gunda et al. |

(Continued)

FOREIGN PATENT DOCUMENTS

| | | | |
|---|---|---|---|
| EP | 0 027 743 | A1 | 4/1981 |
| JP | 53-110102 | A | 9/1978 |

(Continued)

OTHER PUBLICATIONS

International Search Report (PCT/ISA/210) dated Jun. 10, 2014, with English translation (four (4) pages).

*Primary Examiner* — Rodney Butler
(74) *Attorney, Agent, or Firm* — Crowell & Moring LLP

(57) ABSTRACT

Provided is a driving device for a working machine, which can drive one or more hydraulic pumps in a large capacity range of as high efficiency as possible. In a driving device for a hydraulic excavator, a controller (41) is provided with a first target delivery-flow-rate setting unit (41*a*) that computes a first target delivery flow rate of pressure oil, which is to be delivered from at least one of variable displacement hydraulic pumps (2*a*-2*f*) to a hydraulic actuator, according to a lever stroke from one of control devices 40*a*,40*b* and corresponding one of preset efficiency values set beforehand for the hydraulic pumps.

2 Claims, 30 Drawing Sheets

(52) U.S. Cl.
CPC ..... *E02F 9/2292* (2013.01); *E02F 9/2296* (2013.01); *F04B 1/26* (2013.01); *F04B 49/065* (2013.01); *F15B 13/06* (2013.01); *F15B 2211/20546* (2013.01); *F15B 2211/20561* (2013.01); *F15B 2211/20569* (2013.01); *F15B 2211/20576* (2013.01); *F15B 2211/405* (2013.01); *F15B 2211/6346* (2013.01); *F15B 2211/6652* (2013.01)

(56) References Cited

U.S. PATENT DOCUMENTS 5,083,430 A * 1/1992 Hirata ..... E02F 9/2225 137/596.14
5,930,996 A * 8/1999 Nakamura ..... E02F 9/2235 60/426
2004/0020082 A1 2/2004 Ariga et al.
2005/0246082 A1 * 11/2005 Miki ..... E02F 9/2075 701/50

FOREIGN PATENT DOCUMENTS

JP 56-59005 A 5/1981
JP 56-85581 A 7/1981
JP 59-91238 A 5/1984
JP 62-25882 B2 6/1987
JP 63-309789 A 12/1988
JP 2002-242904 A 8/2002
JP 2010-255244 A 11/2010

* cited by examiner

FIG. 7

| | HYDRAULIC PUMPS | | | | | |
|---|---|---|---|---|---|---|
| | 2a | 2b | 2c | 2d | 2e | 2f |
| BOOM CYLINDER 7a | 1/1 | 2/1 | 3/2 | 1/2 | 2/2 | 3/1 |
| ARM CYLINDER 7b | 2/1 | 1 | 2/2 | 3 | – | – |
| BUCKET CYLINDER 7c | 3/3 | 3/2 | 1/1 | 2 | 3/1 | 1/2 |
| SWING MOTOR 10c | – | – | – | – | 1 | 2 |

FIG. 17

| | HYDRAULIC PUMPS | | | | | |
|---|---|---|---|---|---|---|
| | 2a | 2b | 2c | 2d | 2e | 2f |
| BOOM CYLINDER 7a | (1/1) | (2/1) | (3/2) | (1/2) | (2/2) | (3/1) |
| ARM CYLINDER 7b | 2/1 | 1 | 2/2 | 3 | – | – |
| BUCKET CYLINDER 7c | 3/3 | 3/2 | 1/1 | 2 | 3/1 | 1/2 |
| SWING MOTOR 10c | – | – | – | – | 1 | 2 |

FIG. 19

| | HYDRAULIC PUMPS | | | | | |
|---|---|---|---|---|---|---|
| | 2a | 2b | 2c | 2d | 2e | 2f |
| BOOM CYLINDER 7a | (1/1) | (2/1) | (3/2) | (1/2) | 2/2 | 3/1 |
| ARM CYLINDER 7b | 2/1 | 1 | 2/2 | 3 | – | – |
| BUCKET CYLINDER 7c | 3/3 | 3/2 | 1/1 | 2 | 3/1 | 1/2 |
| SWING MOTOR 10c | – | – | – | – | (1) | (2) |

FIG. 30

$$PWt1=\sum_{n=1}^{m}\left(\Delta PLn\times\sum_{j=1}^{sn}\frac{QR1nj}{Psnj}\right)\cdots(1)$$

$$QRCnj=QR1nj\times KL\cdots(2)$$

$$PWtC=\sum_{n=1}^{m}\left(\Delta PLn\times\sum_{j=1}^{sn}\frac{QRCnj}{Psnj}\right)\cdots(3)$$

$$QCn=\sum_{j=1}^{sn}(QRCnj)\cdots(4)$$

APPARATUS FOR DRIVING WORK MACHINE

TECHNICAL FIELD

This invention relates to a driving device for a working machine, which includes a closed hydraulic circuit for directly driving desired one of hydraulic actuators by at least one of hydraulic pumps.

BACKGROUND ART

In recent years, energy saving systems have been attracting interest in working machines such as hydraulic excavators and wheel loaders, and hybrid working machines and the like, which recover regeneration energy upon braking, have been put in the market. In many of such hybrid working machines which have been put in the market to date, however, their drive systems include an electrical system added to a conventional hydraulic system, and therefore are not different in that the flow rate to each hydraulic actuator is adjusted by controlling the opening of a control valve as a directional control valve, in other words, by restricting such a control valve while producing pressure loss.

For the energy saving of a working machine, the importance lies in the energy saving of its hydraulic system itself, and a significant effect can be obtained especially by reducing a restriction pressure loss that occurs across a control valve. As energy-saving driving device for working machines, developments are hence underway on closed hydraulic circuit systems that directly control each hydraulic actuator by connecting it to its corresponding hydraulic pump through a closed circuit. These systems use no control valve, and therefore are free of a pressure loss that would otherwise be produced by a control valve. Accordingly, the hydraulic pump delivers pressure oil at only a required flow rate, thereby making it possible to reduce a loss in flow rate. Further, these systems can regenerate the potential energy of such hydraulic actuators and the energy upon deceleration, and therefore are very effective systems as energy-saving systems.

With a closed hydraulic circuit system, however, the maximum output of a hydraulic actuator needs to be provided by a single hydraulic pump, leading to a problem that the pump becomes larger.

As a conventional technology that a closed hydraulic circuit system is configured without any increase in the size of a pump, there is the technology disclosed in Patent Document 1. According to the technology disclosed in this Patent Document 1, plural variable displacement hydraulic pumps are arranged, and the number of the pump(s) to be connected through a closed circuit to a hydraulic actuator and the delivery flow rate of each of the pump(s) are computed. By connecting each of the plural variable displacement hydraulic pumps to two or more hydraulic actuators through a closed circuit by way of selector solenoid valves and driving each hydraulic actuator with pressure oil from one or more of the hydraulic pumps, flow rates can be secured as desired by an operator without enlargement of the variable displacement hydraulic pumps.

In the case of a closed hydraulic circuit system, each variable displacement hydraulic pump is driven by an engine or electric motor that undergoes substantially uniform rotation, and the capacity of the variable displacement hydraulic pump is controlled by a regulator or the like to vary the delivery flow rate of the pump. In general, a variable displacement hydraulic pump has the characteristic that its efficiency is good in a large capacity range but is lowered in a small to medium capacity range. To further improve the energy saving effect of the closed hydraulic circuit system, it is desired to use each hydraulic pump in its large capacity range wherever possible.

PRIOR ART DOCUMENT

Patent Document

Patent Document 1: JP-B-62-25882

DISCLOSURE OF THE INVENTION

Problem to be Solved by the Invention

Concerning the above-mentioned technology disclosed in Patent Document 1, the computation of a delivery flow rate of a hydraulic pump with respect to a hydraulic actuator to be driven is disclosed, but no reference is made to a computation according a hydraulic pump efficiency. It is, however, possible to imagine a situation that a delivery flow rate may be computed at a relatively low hydraulic pump efficiency. Accordingly, an inherently available efficiency may not be obtained. In addition, the maximum output that a prime mover, which drives one or more hydraulic pumps, can produce may become lower than an output needed for the hydraulic actuator. In this situation, the delivery flow rate of at least one hydraulic pump needs to be lowered than the delivery flow rate given by an operation command so that the output needed by the hydraulic actuator is reduced to or below the maximum output of the prime mover. Here again, the inherently available efficiency may not be obtained as in the above-mentioned situation.

With the above-mentioned circumstances of the conventional technology in view, the present invention has as an object thereof the provision of a driving device for a working machine, which can drive one or more hydraulic pumps in a large capacity range of as high efficiency as possible.

Means for Solving the Problem

To achieve this object, the present invention is characterized in that in a driving device for a working machine, comprising a prime mover, a plurality of hydraulic pumps to which drive force is fed by the prime mover, delivery flow rate varying devices that vary delivery flow rates of the hydraulic pumps, respectively, a plurality of hydraulic actuators, connection devices that connect desired one of the hydraulic actuators and at least one of the hydraulic pumps through a closed circuit, control devices that generate control signals for the hydraulic actuators, load pressure detection devices that detect load pressures on the hydraulic actuators, and a controller that controls the delivery flow rate varying devices and the connection devices according to the control signal from at least one of the control devices, the controller comprises a first target delivery-flow-rate setting unit that computes a first target flow rate of the at least one hydraulic pump, which delivers pressure oil to the desired one hydraulic actuator, according to the control signal from the at least one control device and corresponding one of preset efficiency-setting values for the hydraulic pumps.

According to the present invention configured as described above, one or more of the hydraulic pumps can be driven in a large capacity range of high hydraulic pump efficiency based on a computation that is performed in view of the corresponding one or more of the preset efficiency values, which have been set beforehand, by the first target delivery-flow-rate setting unit provided in the controller.

The present invention may also be characterized in that in the invention described above, the controller further comprises a hydraulic pump state amount computing unit that computes one of an efficiency of the at least one hydraulic pump according to the load pressure of one of the load pressure detection devices for the desired one hydraulic actuator and a delivery flow rate of the at least one hydraulic pump based on the preset efficiency value for the at least one hydraulic pump; an output limiting unit that limits an output demand of the desired one hydraulic actuator according to the first target flow rate calculated by the first target delivery-flow-rate setting unit, the load pressure from the one load pressure detector, the delivery flow rate computed by the hydraulic pump state amount computing unit, and a preset threshold level of output for the prime mover; and a second target delivery-flow-rate setting unit that computes a second target delivery flow rate of the at least one hydraulic pump, which delivers the pressure oil to the desired one hydraulic actuator, according to a computed value from the output limiting unit and the delivery flow rate from the hydraulic pump state amount computing unit.

According to the present invention configured as described immediately above, one or more of the hydraulic pumps can be driven in a large capacity range of high hydraulic pump efficiency based on a computation performed by the second target delivery-flow-rate setting unit provided in the controller while using one or more computed values from the output limiting unit and one or more delivery flow rates from the hydraulic pump state amount computing unit, both of which are provided in the controller, even at the time of the maximum output that can be produced by the prime mover which drives the hydraulic pumps.

Advantageous Effects of the Invention

According to the present invention, one or more of the plural hydraulic pumps can be driven in a large capacity range of as high hydraulic pump efficiency as possible based on a computation which is performed by the first target delivery-flow-rate computing unit in view of the corresponding one or more of the preset values of efficiency as set beforehand although the use of such preset values of efficiency has not been taken into consideration conventionally. As a consequence, the present invention can further improve the efficiency of such a closed hydraulic circuit system.

BRIEF DESCRIPTION OF THE DRAWINGS

FIG. 7 is a correlation table showing the order of connection between hydraulic actuators and connectable hydraulic pumps and stored in a connection determining unit depicted in FIG. 4.

FIG. 17 is a table illustrating the first operation example of the first embodiment of the driving device according to the present invention for the working machine as described with reference to the correlation table shown in FIG. 7.

FIG. 19 is a table illustrating the second operation example of the first embodiment of the driving device according to the present invention for the working machine as described with reference to the correlation table shown in FIG. 7.

FIG. 30 shows computing equations to be executed by the controller depicted in FIG. 3.

MODES FOR CARRYING OUT THE INVENTION

Embodiments of the driving device according to the present invention for the working machine will hereinafter be described with reference to the drawings.

Figure 1:
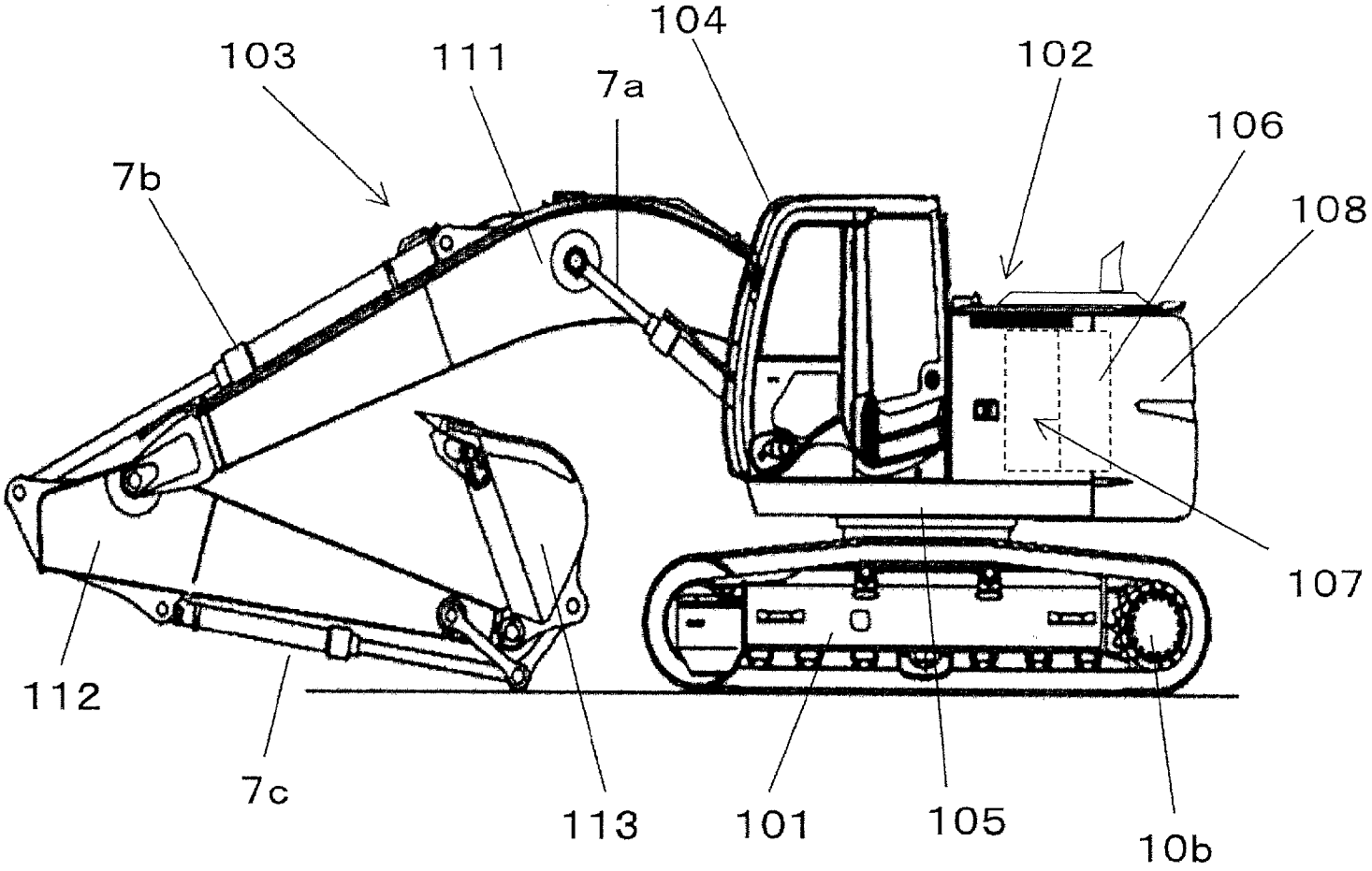
FIG. 1 is a side view showing a hydraulic excavator including a first embodiment of the driving device according to the present invention for the working machine.

FIG. 1 is a side view showing a hydraulic excavator including a first embodiment of the driving device according to the present invention for the working machine.

The hydraulic excavator with the first embodiment included therein is provided with a travel base 101, and an upperstructure 102 is mounted on the travel base 101. A main body is configured of the travel base 101 and upperstructure 102. The travel base 101 rotationally drives crawler tracks, which provided on left and right sides of the main body, to perform traveling. The travel base 101 is also provided with a travel motor 10*b* and an unillustrated travel motor 10*a*, which are hydraulic actuators and provide travel power to the left and right crawler tracks. Although not shown in the figure, the upperstructure 102 is rotatable relative to the travel base 101 by a bearing mechanism interposed between upperstructure 102 and the travel base 101 and a below-described swing motor 10*c* as a hydraulic actuator. The upperstructure 102 is provided, on a main frame 105 thereof, with a working mechanism 103 at a front part, a counterweight at a rear part, and a cab 104 at a left front part. On a forward side of the counterweight 108, an engine 106 as a prime mover is provided. The upper structure 102 further includes a drive system 107 that is driven by driving power from the engine 106.

As the working mechanism 103, structural members consisting of a boom 111, an arm 112 and a bucket 113 are connected by a linkage mechanism, and are allowed to pivotally move about link shafts, respectively, to perform work such as digging. For the pivotal movements of the boom 111, arm 112 and bucket 113, a boom cylinder 7*a*, an arm cylinder 7*b* and a bucket cylinder 7*c* are provided as hydraulic actuators.

Figure 2:
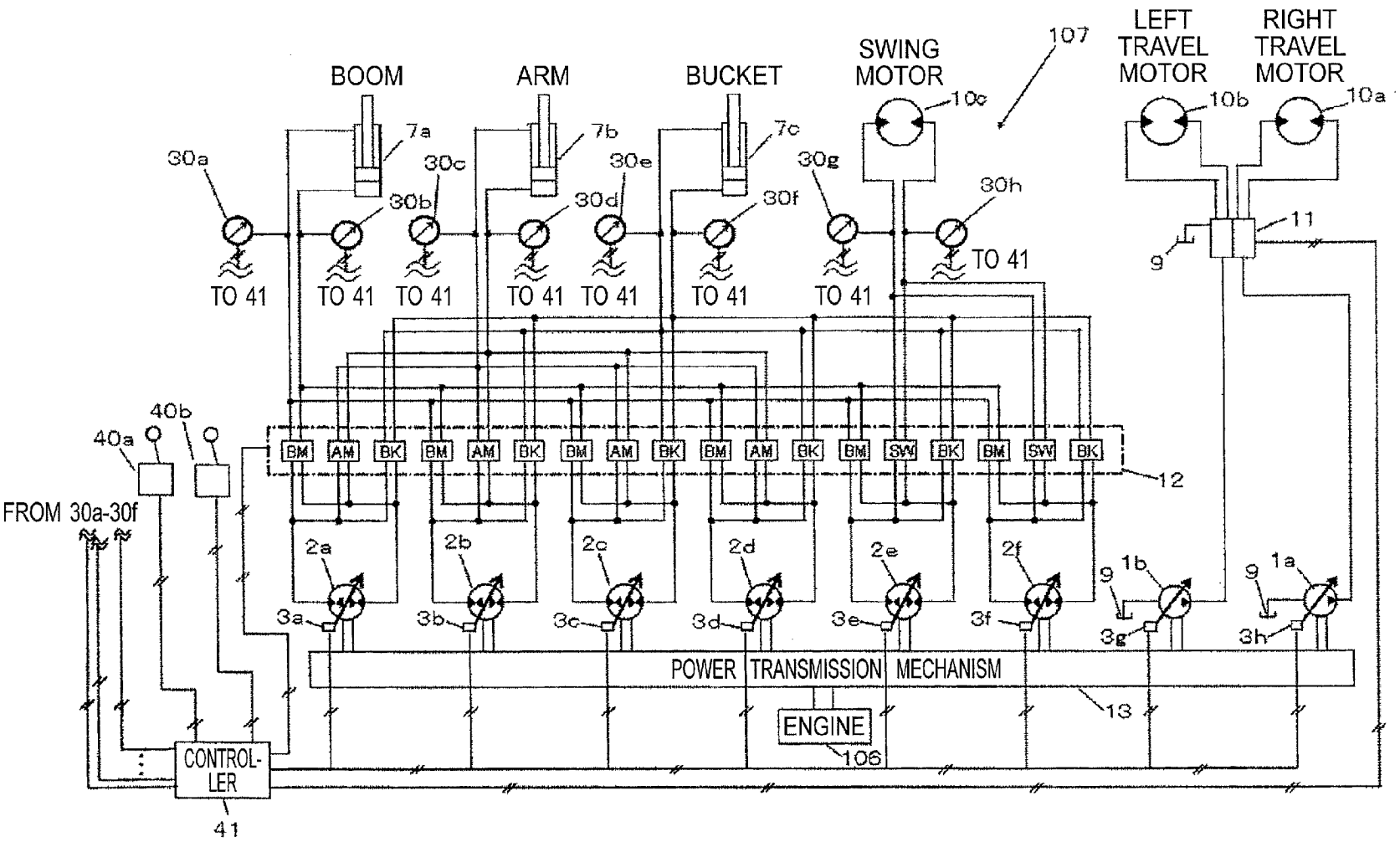
FIG. 2 is a circuit configuration diagram depicting essential parts of a drive system provided in the hydraulic excavator shown in FIG. 1.
Figure 3:
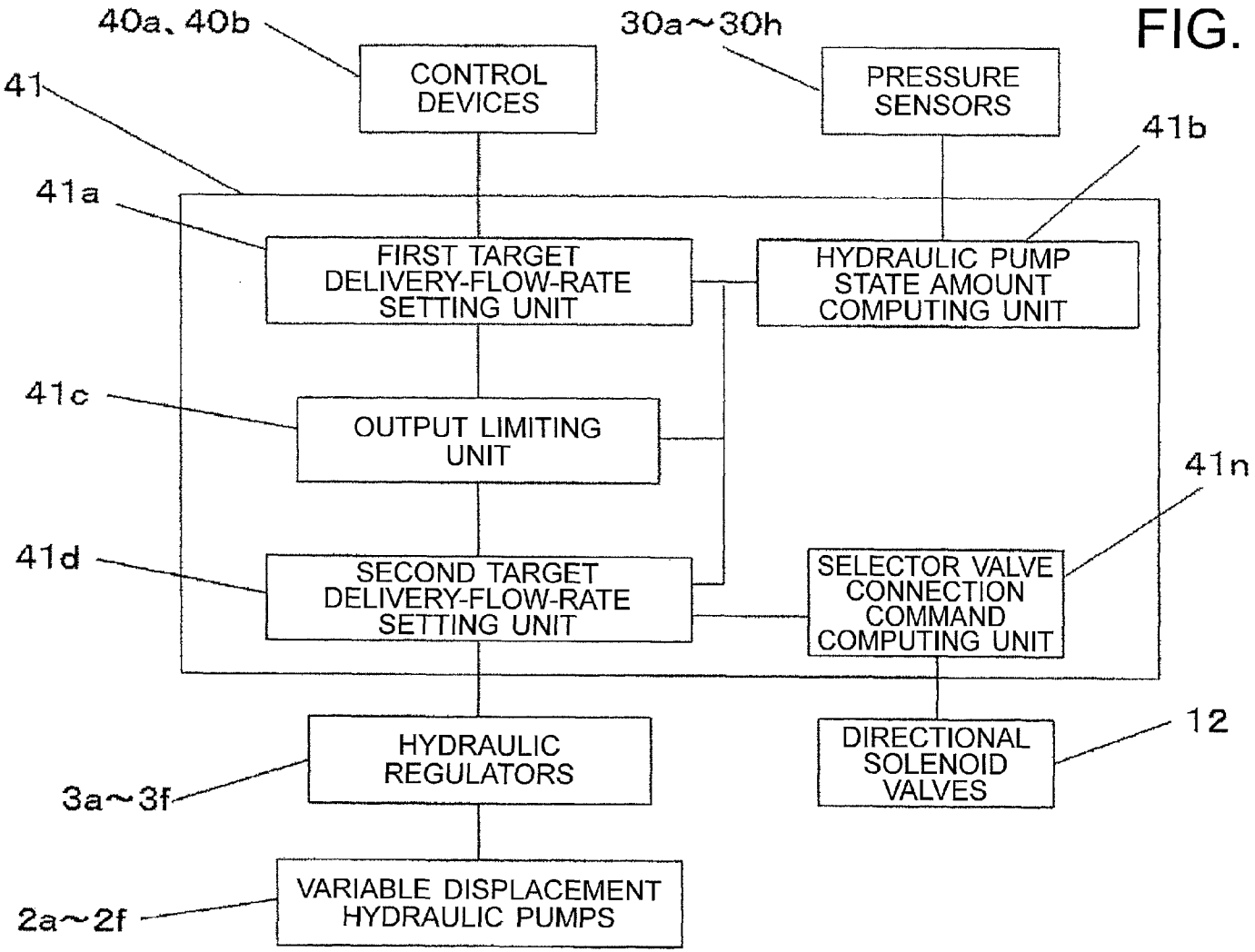
FIG. 3 is a diagram depicting an essential part of a controller provided in the drive system depicted in FIG. 2.

FIG. 2 is a circuit configuration diagram depicting essential parts of the drive system 107 provided in the hydraulic excavator shown in FIG. 1, and FIG. 3 is a diagram depicting an essential part of a controller 41 provided in the drive system depicted in FIG. 2.

As depicted in FIG. 2, the drive system 107 as the driving device for the working machine is configured of a closed hydraulic circuit system and an open hydraulic circuit system. In the closed hydraulic system, variable displacement hydraulic pumps 2*a*-2*f* as hydraulic pumps and the boom cylinder 7*a*, arm cylinder 7*b*, bucket cylinder 7*c* and swing motor 10*c* are connected using a piping without going through control valves. In the open hydraulic circuit system, variable displacement hydraulic pumps 1*a*,1*b* and the travel motors 10*a*,10*b* are connected using a piping via a control valve 11 that controls the rate and direction of a feed flow.

Although the closed hydraulic circuit system and open hydraulic circuit system are combined in the first embodiment, the driving device shall not be limited to this configuration. Depending on the intended application of the working machine, the driving device may take another configuration, for example, by connecting all the hydraulic actuators as a closed hydraulic circuit system.

A description is now made about the above-mentioned closed hydraulic circuit system.

This closed hydraulic circuit system is provided with the engine 106; the plural variable displacement hydraulic pumps 2*a*-2*f* to which driving power as the product of a torque and a rotational speed is fed from the engine 106 via a power transmission mechanism 13 configured of a gear mechanism or the like; hydraulic regulators 3*a*-3*f* as delivery flow rate varying devices that vary the delivery flow rates of the variable displacement hydraulic pumps 2*a*-2*f*; the boom cylinder 7*a*, arm cylinder 7*b*, bucket cylinder 7*c* and swing motor 10*c*; directional solenoid valves 12 as connection devices that connect the boom cylinder 7*a*, arm cylinder 7*b*, bucket cylinder 7*c* and swing motor 10*c* with at least one of the variable displacement hydraulic pumps 2*a*-2*f* through a closed hydraulic circuit; control devices 40*a*,40*b* that generate lever strokes as control signals for the boom cylinder 7*a*, arm cylinder 7*b*, bucket cylinder 7*c* and swing motor 10*c*; pressure sensors 30*a*-30*h* as load pressure detection devices that detect load pressures on the boom cylinder 7*a*, arm cylinder 7*b*, bucket cylinder 7*c* and swing motor 10*c*; and the controller 41 as a control system that controls the hydraulic regulators 3*a*-3*f* and directional solenoid valves 12 according to the lever strokes of the control devices 40*a*,40*b*.

Described specifically, the variable displacement hydraulic pumps 2*a*-2*f* are provided with a bidirectional delivery mechanism that enables to deliver pressure oil from the respective ones of two connection ports, which the variable displacement hydraulic pumps 2*a*-2*f* are each provided with, to determine the drive directions of and delivery flow rates for the boom cylinder 7*a*, arm cylinder 7*b*, bucket cylinder 7*c* and swing motor 10*c*, and the bidirectional delivery mechanism is controlled by the hydraulic regulators 3*a*-3*f*.

When pressure oil is delivered from one of the two connection ports of at least one of the variable displacement hydraulic pumps 2*a*-2*f*, the one connection port is connected by the bidirectional delivery mechanism to one of two connection ports, which at least one hydraulic actuator of the boom cylinder 7*a*, arm cylinder 7*b*, bucket cylinder 7*c* and swing motor 10*c* is provided with, via the corresponding one of the directional solenoid valves 12, and return pressure oil from the other one of the two connection ports, which the at least one hydraulic actuator is provided with, is returned via the corresponding one of the directional solenoid valves 12 to the other one of the two connection ports of the at least one of the variable displacement hydraulic pumps 2*a*-2*f*. A closed hydraulic circuit is, therefore, established through which pressure oil circulates between the at least one of the variable displacement hydraulic pumps 2*a*-2*f* and at least one hydraulic actuator without returning to a tank 9.

It is to be noted that in the closed hydraulic circuit system, the potential energy of the boom 111 or arm 112 and the kinetic energy of the swing motor 102, which are produced when the boom 111 or arm 112 is lowered in the direction of gravitational force and when the swing motion of the upperstructure 102 is stopped, are conducted as regeneration energy to the return pressure oil, and are transmitted to the at least one of the variable displacement hydraulic pumps 2*a*-2*f*. This regeneration energy is transmitted as driving power to at least one of the remaining ones of the variable displacement hydraulic pumps 2*a*-2*f*, said at least one remaining variable displacement hydraulic pump driving at least one of the remaining hydraulic actuators, via the power transmission mechanism 13. As a consequence, an energy saving effect as much as this regeneration energy can be obtained for the engine 106.

Although illustration is omitted in FIG. 2, the closed hydraulic circuit system is also provided with charge pumps and makeup check valves that raise the circuit pressure to avoid cavitations; flush valves each of which replaces the hydraulic oil in each closed circuit while absorbing a difference in flow rate between the head side and the rod side of the corresponding hydraulic actuator as a single-rod hydraulic cylinder; relief valves that relieve hydraulic oil when the pressure of the hydraulic oil rises to or beyond a predetermined value; and the like.

The directional solenoid valves 12 consist of directional solenoid valves as many as 18 in total, which in turn consist of selector valves for "BM", selector valves for "AM", selector valves for "BK" and selector valves for "SW" to connect plural ones of the variable displacement hydraulic pumps 2*a*-2*f* to corresponding one of the boom cylinder 7*a*, arm cylinder 7*b*, bucket cylinder 7*c* and swing motor 10*c*.

Among the directional solenoid valves 12, the selector valves for "BM" are selector valves to be connected to the boom cylinder 7*a*, and are provided such that the variable displacement hydraulic pumps 2*a*-2*f* located upstream of the directional solenoid valves 12 can all be connected at the maximum. The selector valves for "AM" are selector valves to be connected to the arm cylinder 7*b*, and are provided such that among the variable displacement hydraulic pumps 2*a*-2*f* located upstream of the directional solenoid valves 12, the variable displacement hydraulic pumps 2*a*-2*d* can be connected at the maximum. The selector valves for "BK" are selector valves to be connected to the bucket cylinder 7*c*, and are provided such that among the variable displacement hydraulic pumps 2*a*-2*f* located upstream of the directional solenoid valves 12, the variable displacement hydraulic pumps can all be connected at the maximum. The selector valves for "SW" are selector valves to be connected to the swing motor 10*c*, and are provided such that among the variable displacement hydraulic pumps 2*a*-2*f* located upstream of the directional solenoid valves 12, the variable displacement hydraulic pumps 2*e*,2*f* can be connected at the maximum.

It is to be noted that the connection configuration of the above-mentioned directional solenoid valves 12 is not limited to the foregoing and another connection configuration may be adopted depending on the intended application of the working machine.

In the cab 104 where an operator sits, the control devices 40*a*,40*b* are provided to give operation commands to the hydraulic actuators. Although not illustrated in the figure, the control devices 40*a*, 40*b* each include a lever and an unillustrated detection devices. The lever is tiltable forward, rearward, leftward or rightward, and the corresponding one of the detection devices detects the tilt angle of the lever as an operation signal, specifically a lever stroke electrically. Each control device outputs a lever stroke, which has been detected by the corresponding detection device, to the controller 41 as a control unit via electrical wiring.

The above-mentioned control devices 40*a*, 40*b* each have a system that electrically detects a lever stroke. However, the control devices are not limited to such a system, and may include another system such as a hydraulic system. When such a hydraulic system is provided, it may typically be a system that a pilot hydraulic pump is additionally provided and the delivery pressure of this hydraulic pump is reduced according to the lever stroke. It may be configured to detect the reduced pressure of the pressure oil by a pressure sensor other than the above-mentioned pressure sensors 30*a*-30*h* and to output a detection signal, which has been generated by the pressure sensor, as a lever stroke to the controller 41.

At the controller 41, a control computation which will be described subsequently herein is performed to output a below-described first target delivery flow rate or second target delivery flow rate to one of the hydraulic regulators 3*a*-3*f* and also to output a selector valve connection command signal to the associated directional solenoid valve 12, whereby the one hydraulic regulator and the associated directional solenoid valve 12 are controlled, respectively.

In the open hydraulic circuit system, on the other hand, the variable displacement hydraulic pumps 1*a*, 1*b* which constitute the open hydraulic circuit system are provided with one-way delivery mechanisms, respectively, because the control valve 11 which determines the drive directions and delivery flow rates of the drive motors 10*a*,10*b* is provided downstream of the variable displacement hydraulic pumps 1*a*,1*b* as mentioned above. Described specifically, the variable displacement hydraulic pumps 1*a*,1*b* are each provided with the two connection ports, one of the connection ports is connected as a suction port from the tank 9, where pressure oil is temporarily reserved, to the tank 9 by using a piping, and the other connection port is connected as a delivery port to the connection port of the control valve 11. The delivery flow rate from the delivery port is controlled by a one-way delivery mechanism. The one-way delivery mechanism is controlled by hydraulic regulators 3*g*,3*h*. Further, the return flow rate from the travel motors 10*a*,10*b* is returned to the tank 9 via the control valve 11. The control valve 11 and hydraulic regulators 3*g*,3*h* are controlled according to lever strokes generated by unillustrated control devices provided in the cab 104. These lever strokes are outputted to the controller 41, the controller 41 performs control computations, which are different from those performed by the unillustrated closed hydraulic circuit system, to convert the lever strokes to output signals, and the output signals are outputted to the control valve 11 and hydraulic regulators 3*g*,3*h* via the electrical wiring.

The description will hereinafter return to the closed hydraulic circuit system.

The configuration of the controller 41 will next be described using FIG. 3.

Described specifically, the controller 41 is provided with a first target delivery-flow-rate setting unit 41*a* that computes a first target flow rate of at least one of the variable displacement hydraulic pumps 2*a*-2*f*, said at least one variable displacement hydraulic pump being to deliver pressure oil to desired one of hydraulic actuators, according to a lever stroke of one of the control devices 40*a*,40*b* and corresponding at least one of preset efficiency values set beforehand for the variable displacement hydraulic pumps 2*a*-2*f*.

The controller 41 further includes a hydraulic pump state amount computing unit 41*b*, an output limiting unit 41*c*, and a second target delivery-flow-rate setting unit 41*d*. The hydraulic pump state amount computing unit 41*b* computes either the efficiency of at least one of the variable displacement hydraulic pumps 2*a*-2*f* according to the load pressure from one of the pressure sensors 30*a*-30*h* or a delivery flow rate of the at least one of the variable displacement hydraulic pumps 2*a*-2*f* based on the corresponding one of the preset efficiency values of the variable displacement hydraulic pumps 2*a*-2*f*. The output limiting unit 41*c* limits the output demand of the desired one hydraulic actuator according to the load pressure from the one of the load pressure sensors 30*a*-30*h*, the delivery flow rate computed by the hydraulic pump state amount computing unit 41*b* and a preset threshold level of output for the engine 106. The second target delivery-flow-rate setting unit 41*d* computes the second target delivery flow rate of the at least one of the variable displacement hydraulic pumps 2*a*-2*f*, which delivers pressure oil to the desired one hydraulic actuator, according to a computed value from the output limiting unit 41*c* and the delivery flow rate from the hydraulic pump state amount computing unit 41*b*.

In addition, the controller 41 also includes a selector valve connection command computing unit 41*n*, which from information on each hydraulic actuator as an object of operation and the hydraulic pump, which is to be connected to the hydraulic actuator, as obtained from the second target delivery-flow-rate setting unit 41*d*, outputs a connection command to one of the directional solenoid valves 12, said one directional solenoid valve being to be opened.

The lines that connect between the respective units and devices are signal lines, which indicate input-output relations of data such as lever strokes, load pressures and computation results. The controller 41 is, therefore, configured to permit sharing such data among the individual units included therein.

A description will next be made of the configurations of the individual units included in the controller 41 depicted in FIG. 3 and control steps to be executed at the individual units.

Figure 4:
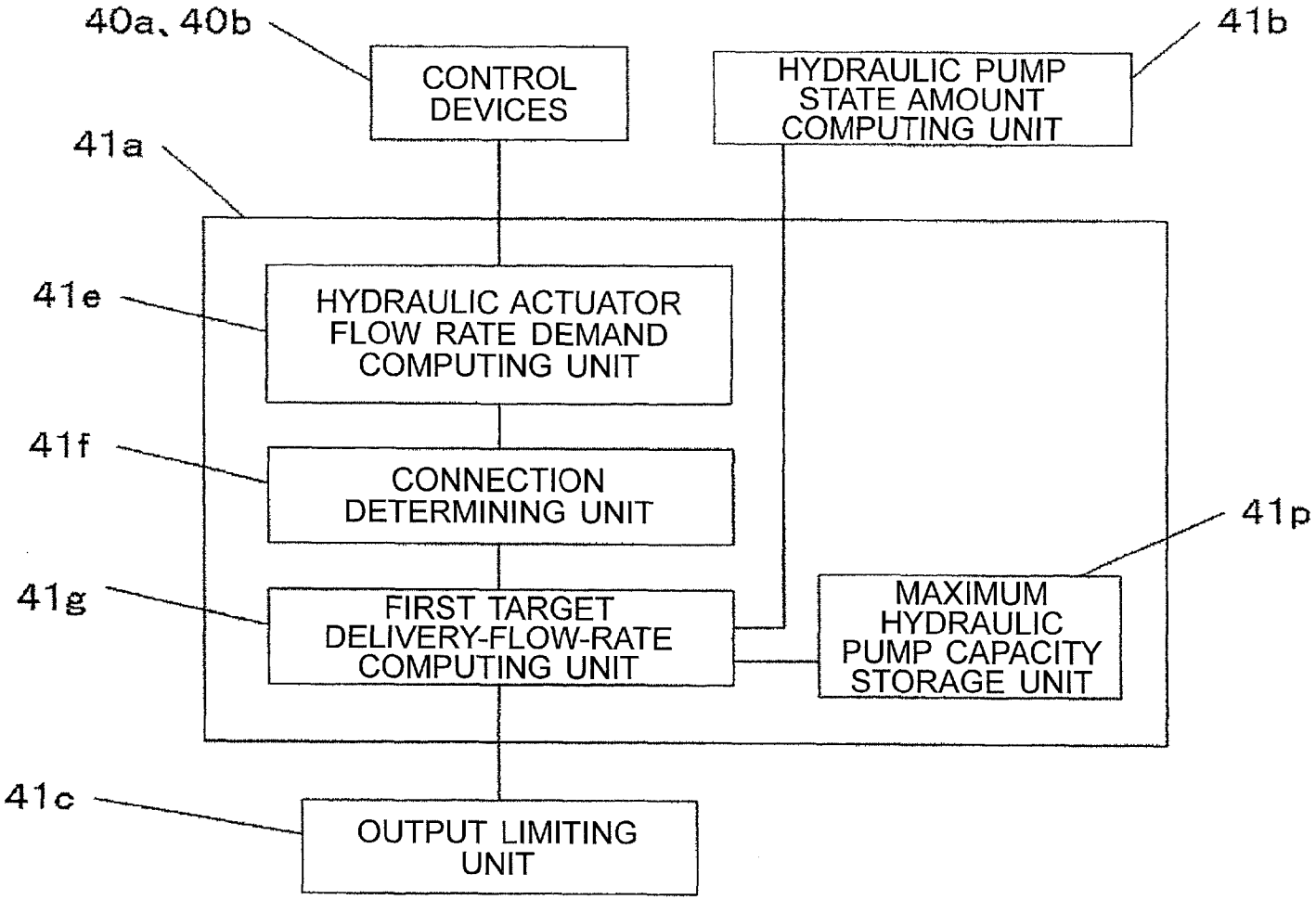
FIG. 4 is a diagram depicting an essential part of a first target delivery-flow-rate setting unit provided in the controller depicted in FIG. 3.
Figure 5:
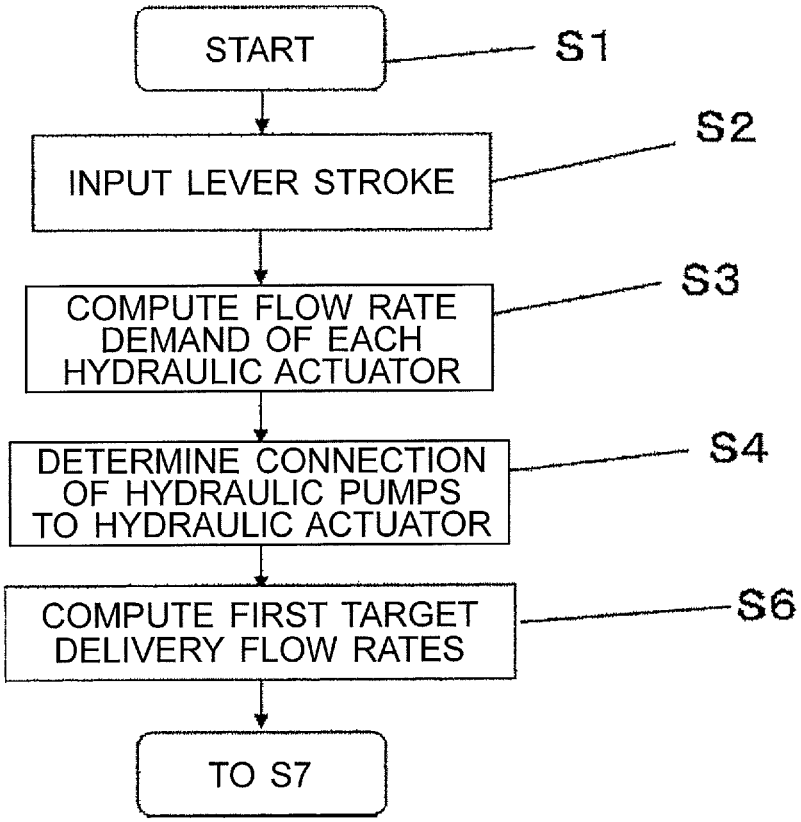
FIG. 5 is a flow chart diagram illustrating a control step at the first target delivery-flow-rate setting unit depicted in FIG. 4.
Figure 6:
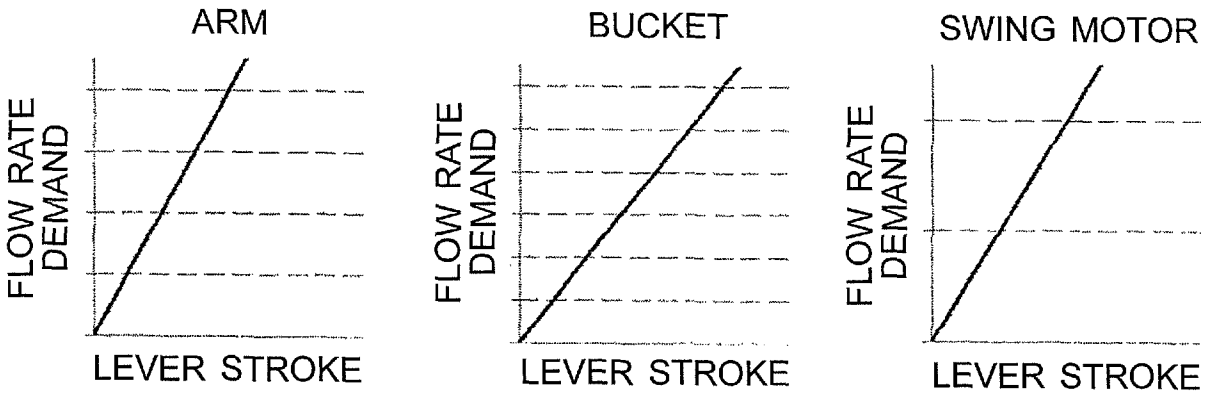
FIG. 6 shows characteristic curve diagrams, which are stored in a hydraulic actuator flow rate demand computing unit depicted in FIG. 4 and illustrate correlations between lever strokes and flow rate demands of plural hydraulic actuators.
Figure 8:
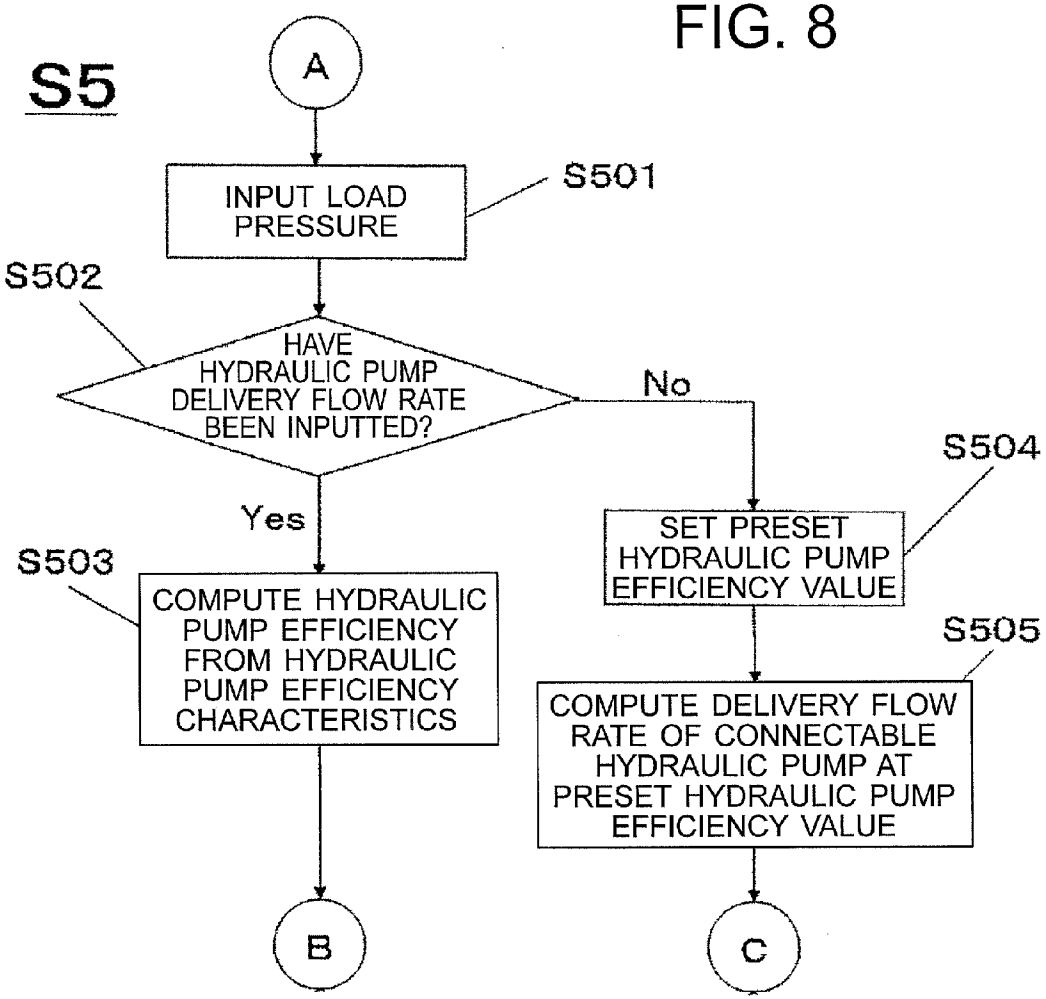
FIG. 8 is a flow chart diagram illustrating a control step at a hydraulic pump state amount computing unit provided in the controller depicted in FIG. 3.
Figure 9:
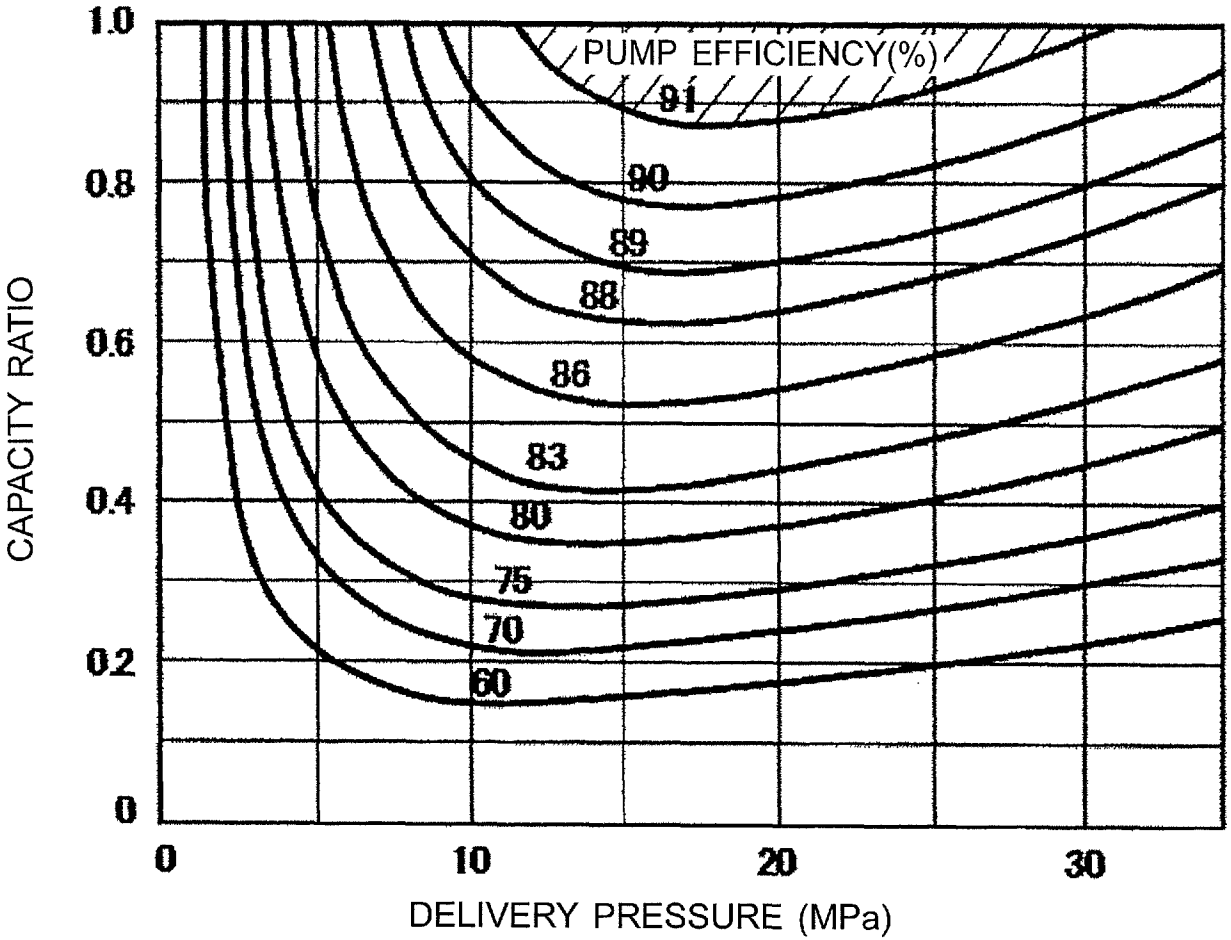
FIG. 9 is a characteristic curve diagram depicting correlations between delivery pressure, capacity ratio and hydraulic pump efficiency and stored in the hydraulic pump state amount computing unit provided in the controller depicted in FIG. 3.
Figure 10:
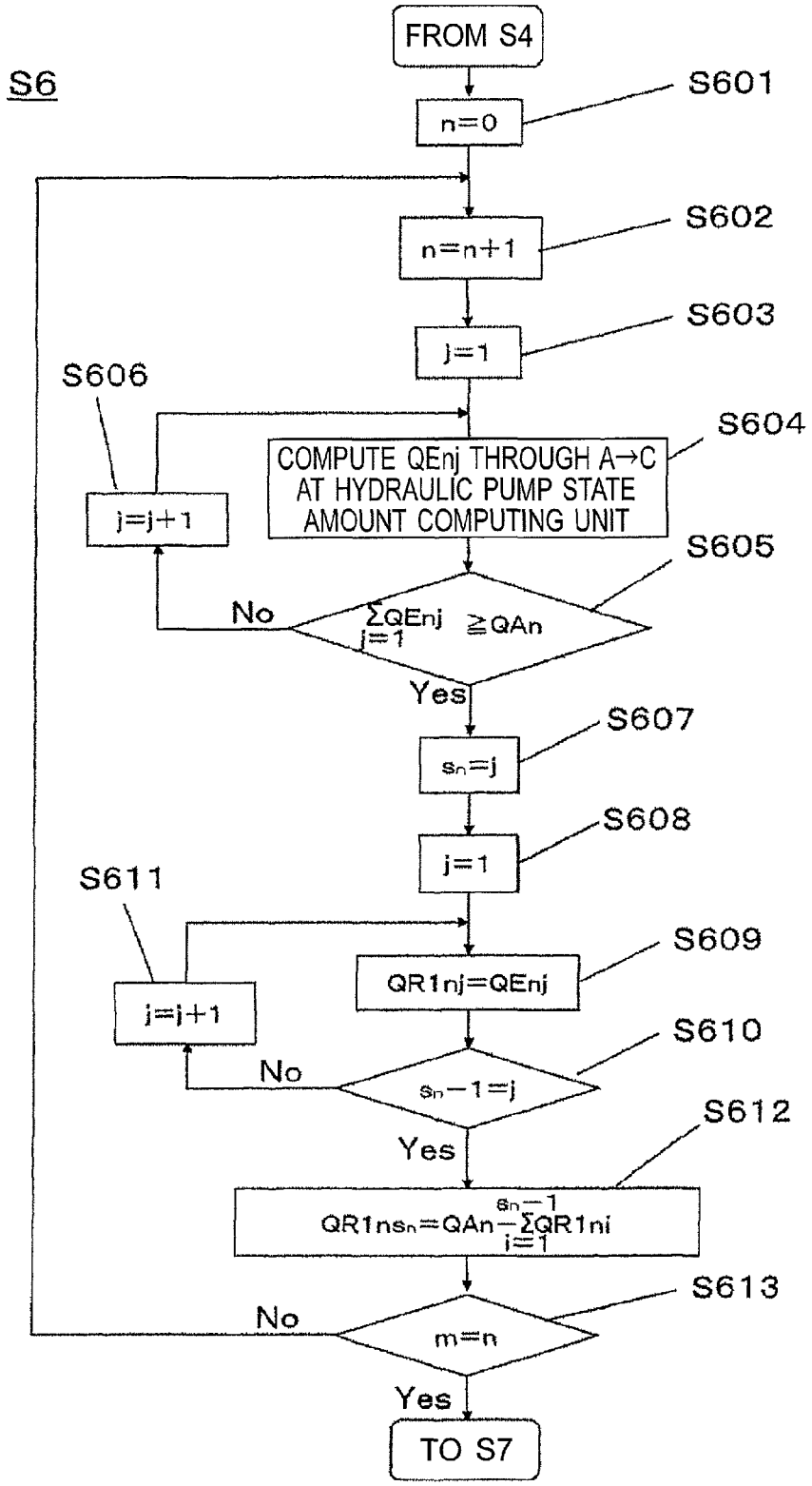
FIG. 10 is a flow chart diagram illustrating the processing in step S6 illustrated in FIG. 5, specifically a control step at the first target delivery-flow-rate computing unit.
Figure 11:
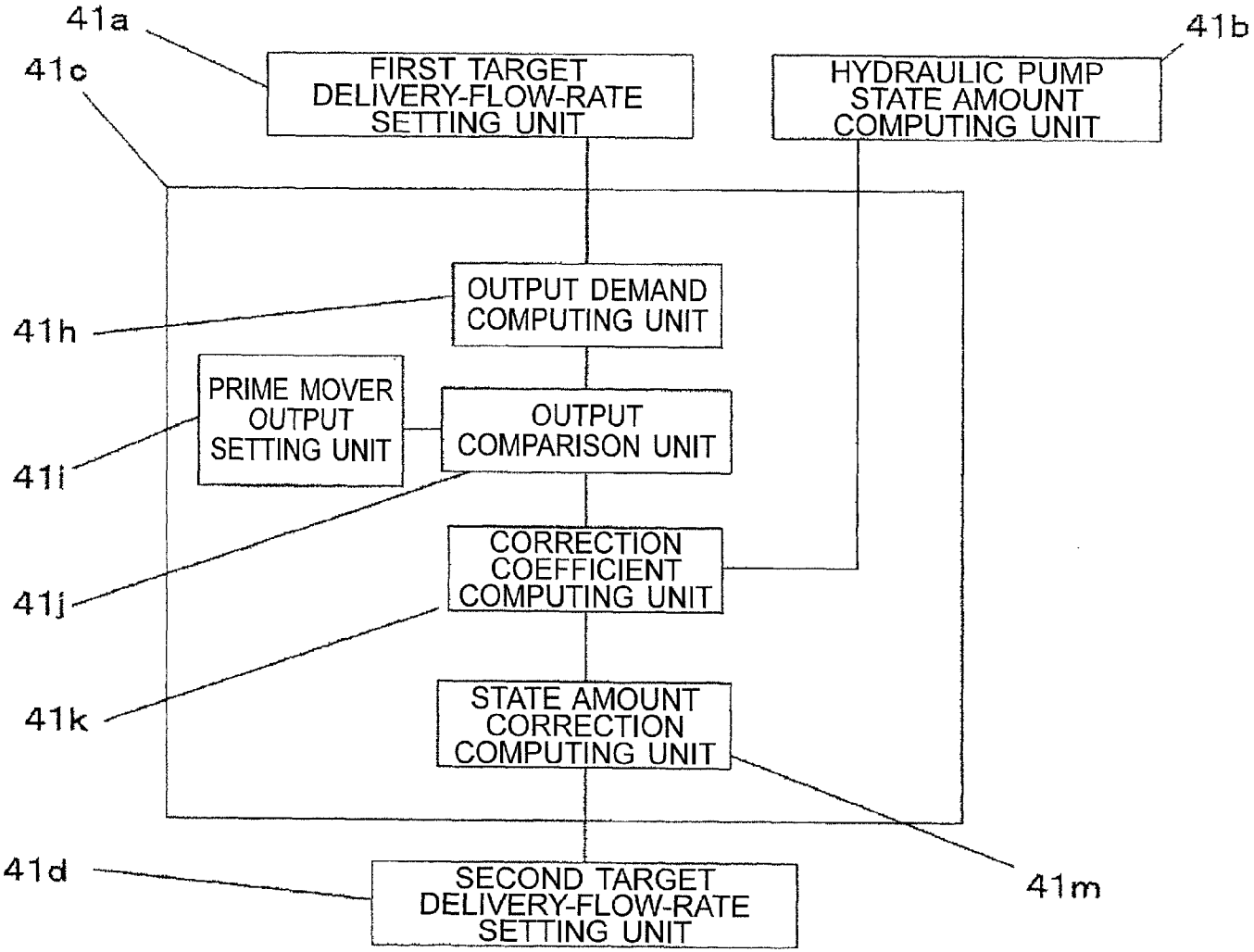
FIG. 11 is a diagram depicting an essential part of an output limiting unit provided in the controller depicted in FIG. 3.
Figure 12:
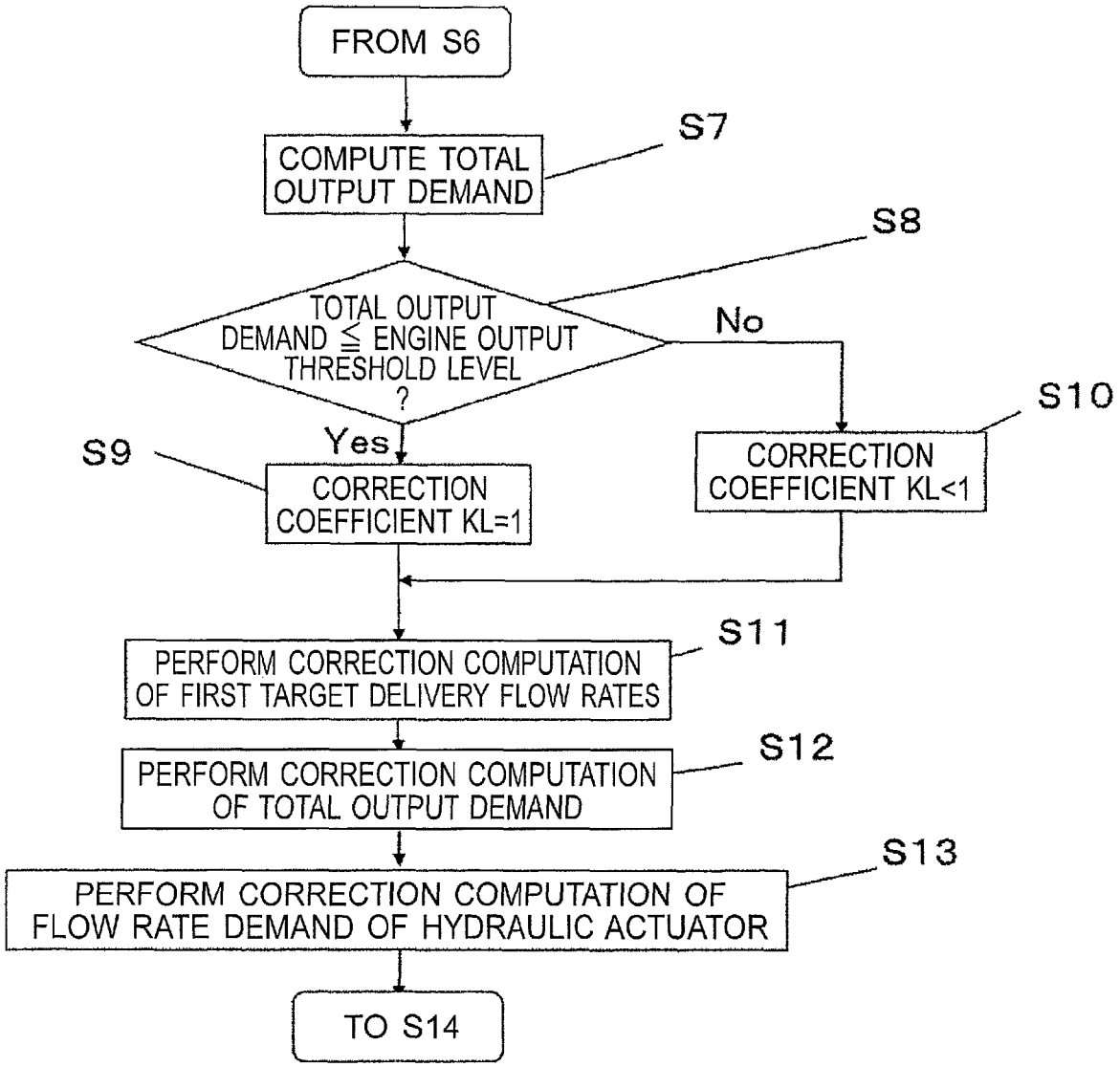
FIG. 12 is a flow chart diagram illustrating a control step at the output limiting unit depicted in FIG. 11.
Figure 13:
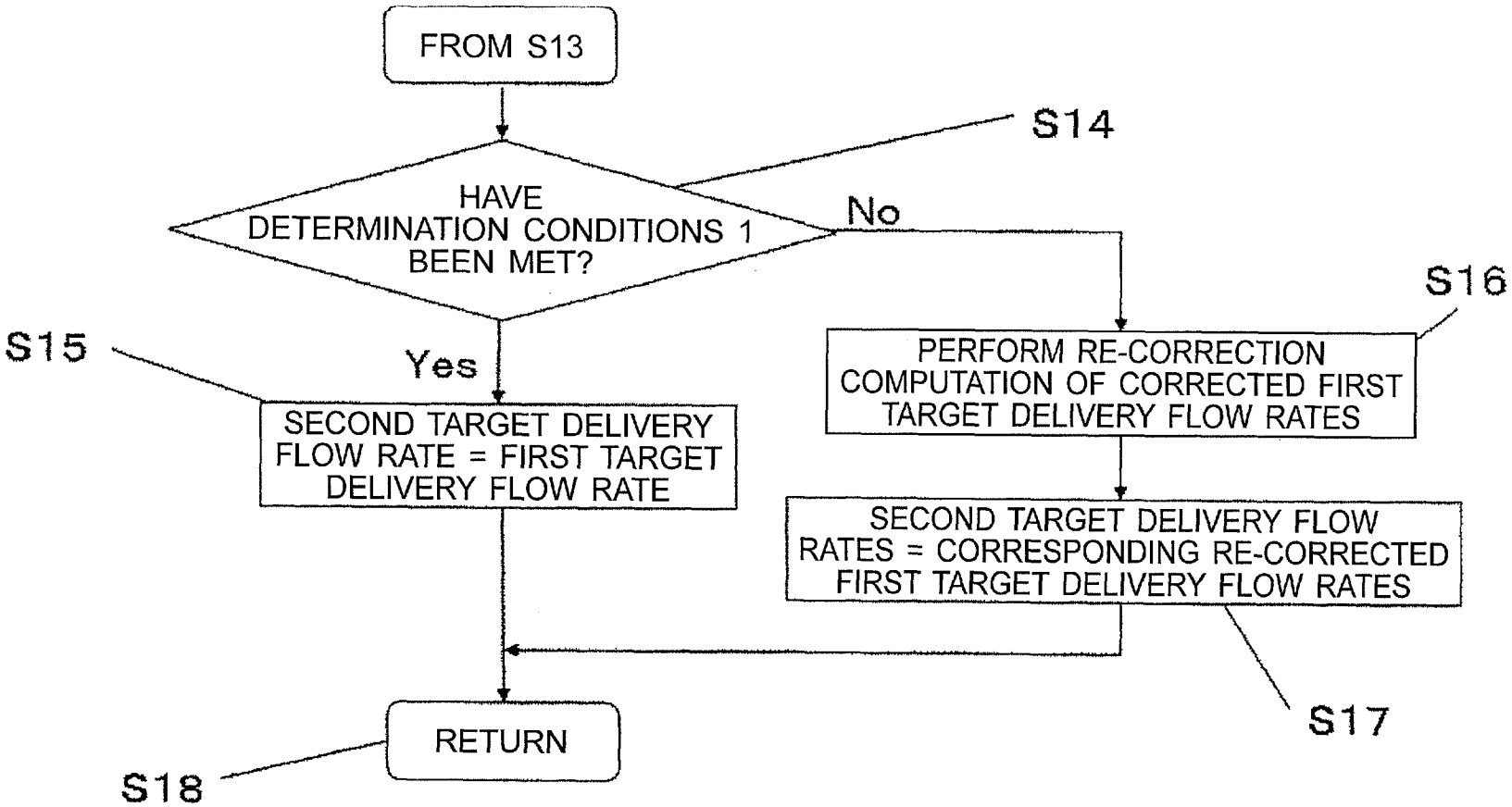
FIG. 13 is a flow chart diagram illustrating a control step at a second target delivery-flow-rate computing unit provided in the controller depicted in FIG. 3.
Figure 14:
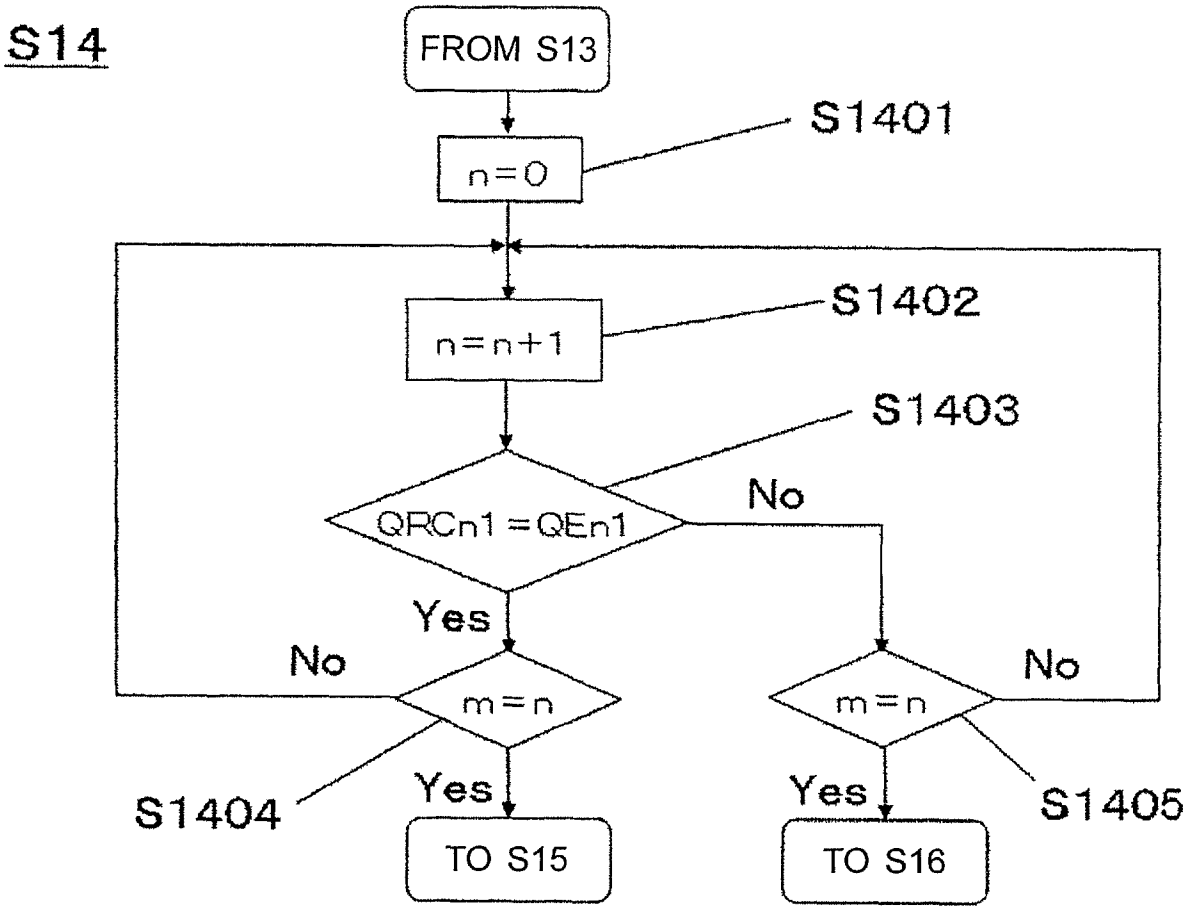
FIG. 14 is a flow chart diagram illustrating the processing in step S14 included in the flow chart depicted in FIG. 13, specifically a control step under determination conditions 1.
Figure 15:
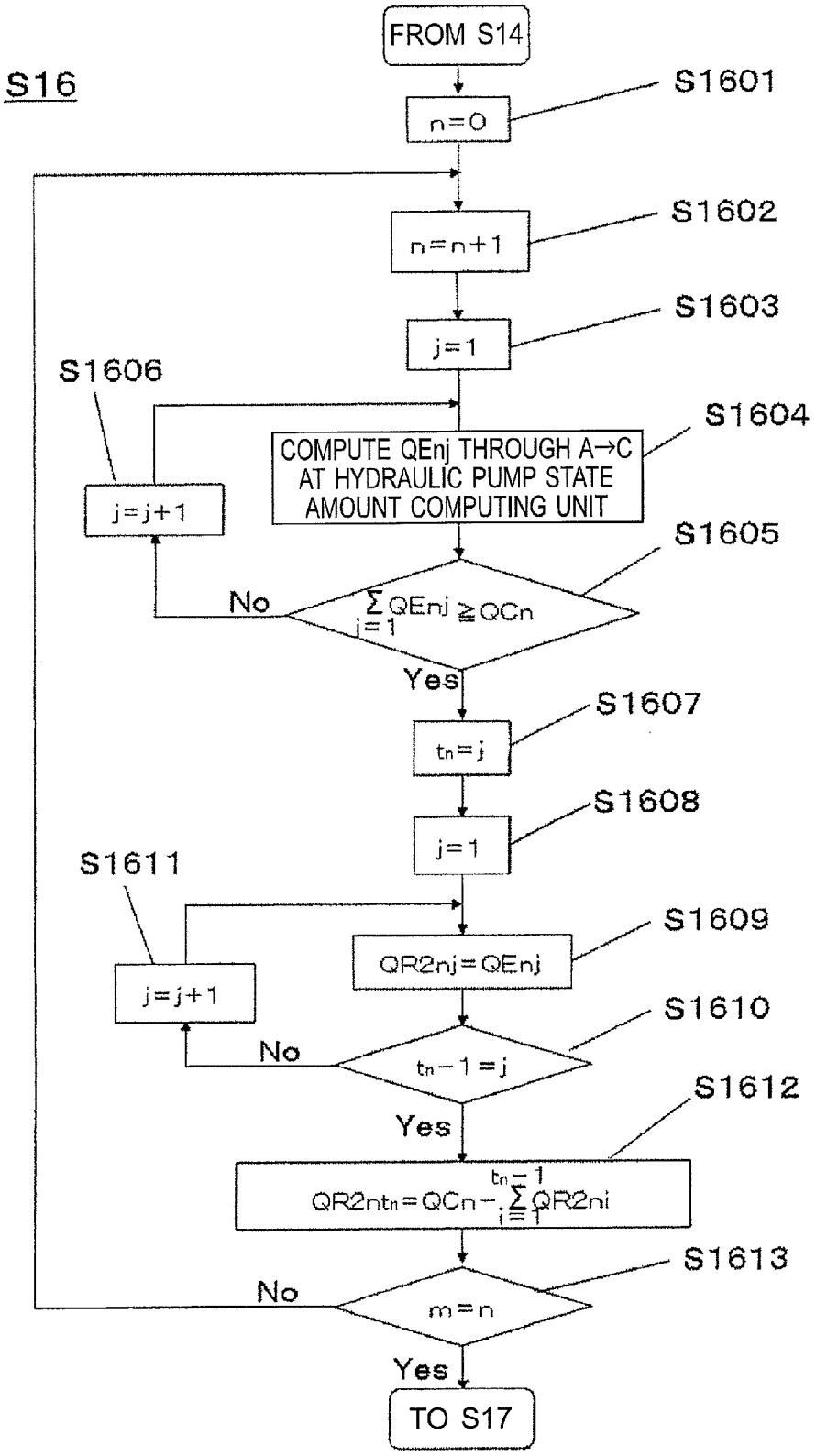
FIG. 15 is a flow chart diagram illustrating the processing in step S16 included in the flow chart depicted in FIG. 13, specifically a control step for a re-correction computation of a corrected first target delivery flow rate.

FIG. 4 is a diagram depicting an essential part of the first target delivery-flow-rate setting unit 41*a* provided in the controller 41 depicted in FIG. 3. FIG. 5 is a flow chart diagram illustrating a control step at the first target delivery-flow-rate setting unit 41*a* depicted in FIG. 4. FIG. 6 shows characteristic curve diagrams, which are stored in a hydraulic actuator flow rate demand computing unit 41*e* depicted in FIG. 4 and illustrate correlations between lever strokes and flow rate demands of the respective hydraulic actuators. FIG. 7 is a correlation table showing the order of connection between hydraulic actuators and connectable hydraulic pumps and stored in a connection determining unit 41*f* depicted in FIG. 4. FIG. 8 is a flow chart diagram illustrating a control step at the hydraulic pump state amount computing unit 41 provided in the controller 41 depicted in FIG. 3. FIG. 9 is a characteristic curve diagram depicting correlations between delivery pressure, capacity ratio and hydraulic pump efficiency and stored in the hydraulic pump state amount computing unit 41*b* provided in the controller 41 depicted in FIG. 3. FIG. 10 is a flow chart diagram illustrating the processing in step S6 illustrated in FIG. 5, specifically a control step at the first target delivery-flow-rate computing unit 41*a*. FIG. 11 is a diagram depicting an essential part of the output limiting unit 41*c* provided in the controller 41 depicted in FIG. 3. FIG. 12 is a flow chart diagram illustrating a control step at the output limiting unit 41*c* depicted in FIG. 11. FIG. 13 is a flow chart diagram illustrating a control step at the second target delivery-flow-rate computing unit 41*d* provided in the controller 41 depicted in FIG. 3. FIG. 14 is a flow chart diagram illustrating the processing in step S14 included in the flow chart depicted in FIG. 13, specifically a control step under determination conditions 1. FIG. 15 is a flow chart diagram illustrating the processing in step S16 included in the flow chart depicted in FIG. 13, specifically a control step for a re-correction computation of a corrected first target delivery flow rate. FIG. 30 shows computing equations to be executed by the controller depicted in FIG. 3.

The control step by the controller 41 starts control at the start in step S1 illustrated in FIG. 5 to be described subsequently herein. When the return in step S18 illustrated in FIG. 13 is reached, the flow returns to the start in step S1. This control is performed in a preset cycle by an unillustrated internal timer.

The first target delivery-flow-rate setting unit 41*a* depicted in FIG. 4 includes the hydraulic actuator flow rate demand computing unit 41*e*, the connection determining unit 41*f*, a maximum hydraulic pump capacity storage unit 41*p*, and a first target delivery-flow-rate computing unit 41*g*, and outputs data to the outside. The hydraulic actuator flow rate demand computing unit 41*e* computes, according to a lever stroke from the control device 40*a* or 40*b*, a flow rate demand of the corresponding one hydraulic actuator, as the target of operation, of the boom cylinder 7*a*, arm cylinder 7*b*, bucket cylinder 7*c* and swing motor 10*c*. The connection determining unit 41*f* determines to connect the hydraulic actuator as the object of operation and one or more of the variable displacement hydraulic pumps 2*a*-2*f*, said one or more variable displacement hydraulic pumps being to deliver pressure oil to the hydraulic actuator as the object of operation. The maximum hydraulic pump capacity storage unit 41*p* stores maximum capacities, at which the variable displacement hydraulic pumps 2*a*-2*f* can deliver pressure oil at their maximum delivery flow rates, respectively. The first target delivery-flow-rate computing unit 41*g* computes first target delivery flow rates of the one or more hydraulic pumps that are to deliver the pressure oil.

The control step at the first target delivery-flow-rate setting unit 41*a* depicted in FIG. 4 moves to step S2 after the start of the control in step S1 as illustrated in FIG. 5. The control in step S1 is started when the controller 41 has inputted a key operation signal, which commands a start-up of the engine 106, and a command signal from an unillustrated external device such as a dedicated switch.

In step S2, illustrated is a step that the lever stroke, which has been generated as a result of the operation of the control device 40*a* or 40*b* by the operator, is inputted to the hydraulic actuator flow rate demand computing unit 41*e*. The flow then moves to step S3.

In step S3, illustrated is a step that at the hydraulic actuator flow rate demand computing unit 41*e*, the flow rate demand of each hydraulic actuator as a target of operation is computed according to the corresponding lever stroke. Illustrated by way of example in this embodiment is a computation that uses the corresponding characteristic curve diagram shown in FIG. 6 and illustrating the correlation between the lever stroke and the flow rate demand of the hydraulic actuator. In this characteristic curve diagram, each flow rate demand is in a one-to-one correlation with its corresponding lever stroke, so that relative to a given lever stroke, a flow rate demand can be computed uniquely. Further, hydraulic actuator(s) as target(s) of operation are stored, and its or their number is counted and is stored as a number m of hydraulic actuator (s). The hydraulic actuator (s) as targets of operation and the number m of the hydraulic actuator(s), both of which have been stored, are outputted to the outside, and the flow moves to step S4. It is to be noted that eight characteristic curve diagrams are needed for the boom, arm, bucket and swing motor because each hydraulic actuator can operate in two directions, but that for a simpler description, the characteristics of a lever stroke and its corresponding flow rate demand of each hydraulic actuator are assumed to be the same in the two operating directions and the lever stroke versus flow rate demand correlations of the boom, arm, actuator and swing motor are represented by the four characteristic curve diagrams.

In step S4, there is illustrated a step that at the connection determining unit 4*f*, the hydraulic pumps connectable to each hydraulic actuator as a target of operation out of the variable displacement hydraulic pumps 2*a*-2*f* are stored, and further that the priority order of connection, in other words, the order of connection is computed. Illustrated by way of example in this embodiment is a computation, which uses a correlation table shown in FIG. 7 and indicating the orders of connection between the respective hydraulic actuators and the hydraulic pumps connectable thereto. Of the numbers given in the correlation table shown in FIG. 7, the numbers shown by themselves or the numbers on the left sides of the slashes in "/" indicate the order of connection that to each hydraulic actuator as a target of operation, the corresponding ones of the variable displacement hydraulic pumps 2*a*-2*f* are to be connected on a priority basis. On the other hand, the numbers on the right sides of the slashes in "/" indicate the order of connection that, when two or three of the variable displacement hydraulic pumps 2*a*-2*f* are the same in the order of connection to the same hydraulic actuator as indicated by the numbers on the left sides of the slash in "/", determines which variable displacement hydraulic pump can be connected prior to the remaining variable displacement hydraulic pump(s).

When the hydraulic actuator as the target of operation is the boom cylinder 7*a*, for example, the connectable hydraulic pumps are all the variable displacement hydraulic pumps 2*a*-2*f*, and the order of their connection is in the order of 2*a*, 2*d*, 2*b*, 2*e*, 2*f* and 2*c*. In the cases that the hydraulic actuators as the targets of operation are the boom cylinder 7*a* and the swing motor 10*c*, respectively, the hydraulic pumps connectable to the boom cylinder 7*a* and the order of their connection are the variable displacement hydraulic pumps 2*a*, 2*d*, 2*b* and 2*c*, and the hydraulic pumps connectable to the swing motor 10*c* and the order of their connection are 2*e* and 2*f*. It is to be noted that the above-specified orders of connection is adopted in this embodiment to simplify the description although it is possible to conceive such a case as the flow rate demand of the boom cylinder 7*a* needs the hydraulic pumps as many as five and that of the swing motor 10*c* needs the variable displacement hydraulic pump 2*e* alone.

In step S4, the connectable hydraulic pumps and the order of their connection, which have been stored as a result of the computation, are outputted to the outside, and the flow moves to step S6.

A description will now be made of the control step at the hydraulic pump state amount computing unit 41*b*.

Step S5 illustrated in FIG. 8 shows, the steps of computing the efficiency of each hydraulic pump at the hydraulic pump state amount computing unit 41*b*, as a move from a desired step A to another desired step B, and the steps of setting the efficiency value of each hydraulic pump and computing the delivery flow rate of the hydraulic pump at the preset efficiency value, as a move from the desired step A to a further desired step C.

The hydraulic pump state amount computing unit 41*b* is inputted with a load pressure on each hydraulic actuator as a target of control in step S501, and performs a determination in step S502 as to whether a delivery flow rate such as a first target delivery flow rate has been inputted. If the delivery flow rate has been inputted, the flow moves to step S503 so that the move from the desired steps A to B will take place. If not inputted, the flow moves to step S504 so that the move from the desired steps A to C will take place.

In step S503, the hydraulic pump efficiency is computed, based on the load pressure inputted in step S501 and the delivery flow rate determined to have been inputted in step S502, while using the hydraulic pump efficiency characteristics stored beforehand in the controller 41 and depicted in FIG. 9. The hydraulic pump efficiency so computed is outputted to the outside, and the flow moves to the desired step B.

In the hydraulic pump efficiency characteristics depicted in FIG. 9, delivery pressures are plotted along the axis of abscissas, and capacity ratios are plotted along the axis of ordinates. Each characteristic curve in the diagram represents a contour line of a hydraulic pump efficiency. The delivery pressures along the axis of abscissas are equivalent to load pressures on each hydraulic actuator, and flow pressure losses across the corresponding selector solenoid valve 12 are ignored in this embodiment. The capacity ratios along the axis of ordinates are equivalent to the ratios of delivery flow rates in a range possible by each hydraulic pump, and are ratios to the maximum capacity that can be delivered. For a simpler description, the hatched region indicated by the highest contour line of hydraulic pump efficiency is set to correspond to the hydraulic pump efficiency of 91%. As the hydraulic pump efficiency characteristics differ from one hydraulic pump to another, it is necessary to grasp them with respect to each hydraulic pump to be used. In this embodiment, however, all the hydraulic pumps are assumed to have the same hydraulic pump efficiency characteristics for a simpler description.

In step S504, a hydraulic pump efficiency value is set. This hydraulic pump efficiency value can be set, as desired, using external equipment such as PC. Subsequent to the setting of the hydraulic pump efficiency value, the flow moves to step S505. Since the hydraulic pump efficiency is desirably used at as high a point as possible, the maximum efficiency is set generally. As the hydraulic pump efficiency can be set as desired, the pump efficiency value can be set, for another reason, at an efficiency different from the maximum efficiency, such as an efficiency a little lower than the maximum efficiency.

In step S505, a delivery flow rate is computed, from the hydraulic pump efficiency characteristics of FIG. 9, based on the load pressure inputted in step S501 and the preset hydraulic pump efficiency value set in step S504. This delivery flow rate is outputted to the outside, and the flow moves to the desired step C.

The description will hereinafter reruns to the control steps in FIG. 5.

In step S6, there is illustrated a step that computes, at the first target delivery flow rate computing unit 41*g*, first target delivery flow rates of the hydraulic pumps, which are connectable to each hydraulic actuator as a target of operation, according to the flow rate demand of the hydraulic actuator and the delivery flow rates of the respective hydraulic pumps at the preset efficiency values set at the hydraulic pump state amount computing unit 41*b*. In this embodiment, the flow chart illustrated in FIG. 10 is given by way of example as the control step of step S6.

Inputting the number m of hydraulic actuator(s) as target(s) of operation and the order of connection of hydraulic pumps connectable to the actuator as the target of operation, step S601 initializes the count number n of the hydraulic actuator(s) as target(s) of operation to 0, and further, step S602 adds 1 to the count number n of the hydraulic actuator(s) as target(s) of operation. The flow moves to step S603.

In step S603, the count number j of the hydraulic pumps to be connected in the above-described order is initialized to 1, and the flow moves to step S604.

Step S604 to step S606 perform the control steps of the desired steps A to C in step S5 illustrated in FIG. 8, whereby the delivery flow rates of the hydraulic pumps, which are connectable to each hydraulic actuator, at their preset hydraulic pump efficiency values, are computed and their sum is determined, and the sum and the flow rate demand of the hydraulic actuator as the target of operation are compared. If the sum is equal to or greater than the flow rate demand, the flow moves to step S607. If the sum is smaller than the flow rate demand, the computation is repeated according to the order of connection until the sum becomes equal to or greater than the flow rate demand. For the sake of convenience in description, the delivery flow rate of each hydraulic pump, which is connectable to each hydraulic actuator as a target of operation, at its preset hydraulic pump efficiency value is represented by QEnj, the sum of such delivery flow rates is represented by Σ(QEnj), and the flow rate demand of the hydraulic actuator as the target of operation is represented by QAn.

In step S607, the count number j of the hydraulic pumps, which are to be connected in the above-described order to the hydraulic actuator as the target of operation, when the sum Σ(QEnj) of the delivery flow rates QEnj of the hydraulic pumps has become equal to or greater than the flow rate demand QAn of the hydraulic actuator is stored as $s_n$, and the flow moves to step S608.

In Step S608, the count number j of the hydraulic pumps to be connected in the above-described order is initialized again to 1, and the flow moves to step S609.

In step S609 to step 611, the delivery flow rate QEnj of each hydraulic pump, which is connectable to the hydraulic actuator as the target of control, at its preset hydraulic pump efficiency value is repeatedly inputted as a first target delivery flow rate in the order of connection until the count number j reaches $s_n-1=1$. When the count number j has reached $s_n-1=1$, the flow moves to step S612. For the sake of convenience in description, each first target delivery flow rate is represented by QR1*nj*.

Step S612 illustrates a computation step that the sum Σ(QR1*nj*) of the first target delivery flow rates until the count number $j=1 \ldots (s_n-1)$ is subtracted from the flow rate demand QAn of the hydraulic actuator as the target of operation to determine the margin as QR1*n*$s_n$. The flow then moves to step S613.

In step S613, a determination is made as to whether the count number n is equal to the number m of all the hydraulic actuators as the targets of operation. If equal, the flow moves to step S7. If not equal, on the other hand, the flow moves to step S602.

Through the control step of step S6, the first target delivery-flow-rate setting unit 41*a* can compute and set hydraulic pumps, which are to be connected to each hydraulic actuator as a target of operation, and their delivery flow rates based on the order of connection computed in step S4 and the preset hydraulic pump efficiency values computed in step S5. As a consequence, if the hydraulic pump efficiency values are set, for example, from the characteristics of FIG. 9 such that they always become equal to the maximum hydraulic pump efficiencies, respectively, the hydraulic pumps connected in the order $j=1 \ldots (s_n-1)$ can deliver pressure oil at delivery flow rates of the maximum hydraulic pump efficiencies, and can be driven in capacity ranges of as high the hydraulic pump efficiency as possible.

The output limiting unit 41*c* depicted in FIG. 11 is provided with the output demand computing unit 41*h*, a prime mover output setting unit 41*i*, an output comparison unit 41*j*, a correction coefficient computing unit 41*k* and a state amount correction computing unit 41*m*, and outputs data to the outside and outputs data to the outside. The output demand computing unit 41*h* determines the output demands of respective hydraulic actuators as targets of operation and their sum, that is, the total output demand from the first target delivery flow rates from the first target delivery-flow-rate setting unit 41*a* and the load pressures. The prime mover output setting unit 41*i* sets the output threshold level of the engine 106. The output comparison unit 41*j* comparatively computes the total output demand from the output demand computing unit 41*h* and the output threshold level from the prime mover output setting unit 41*i*. The correction coefficient computing unit 41*k* calculates correction coefficients, at which a limitation to the output is made, according to the results of a comparative computation at the output comparison unit 41*j* and the hydraulic pump efficiencies from the hydraulic pump state amount computing unit 41*b*. The state amount correction computing unit 41*m* performs a correction computation of the total output demand, correction computation of first target delivery flow rates, and correction computation of the flow rate demand of each individual hydraulic actuator by using correction coefficients.

The control step at the output limiting unit 41*c* will be described using FIG. 12.

In step 7, the output demand computing unit 41*h* is inputted with the first target delivery flow rates from the first target delivery-flow-rate setting unit 41*a*, the load pressure and the preset hydraulic pump efficiency values, and performs the computation of the total output demand according to the equation (1) shown in FIG. 30. The flow moves to step S8. In the equation (1), the total output demand is represented by PWt1, the load pressure on each hydraulic actuator as a target of operation is represented by ΔPLn, and each preset hydraulic pump efficiency value is represented by Psηnj. The load pressure ΔPLn is a differential pressure across the hydraulic actuator as the target of operation. The above-mentioned $s_n$ means the number of hydraulic pumps to be connected, and the above-mentioned j means the count number of hydraulic pumps to be connected in the above-described order. Further, the hydraulic pump efficiency of the margin QR1*n*$s_n$ is computed according to the desired steps A to B in step S5 at the hydraulic pump state amount computing unit 41*b*.

In step S8, the output threshold level for the engine 106 as set at the prime mover output setting unit 41*i* and the total output demand determined at the output demand computing unit 41*h* are compared at the output comparison unit 41*j*. If the total output demand is smaller than the engine output threshold level as a result of the comparison, the total output demand is determined to be smaller than the output threshold level for the engine 106, and the flow moves to step S9. If the total output demand is greater than the engine output threshold level as a result of the comparison, the total output demand is determined to exceed the output threshold level of the engine 106, and the flow moves to step S10.

At the prime mover output setting unit 41*i*, the output threshold level for the engine 106 can be set. The output threshold level can be set as desired, for example, using external equipment such as PC. The output threshold level is generally set at a rated output or an available maximum output because it is desired to effectively use the engine 106. However, the output threshold level can be set as desired, and for another reason, can also be set at an output different from the rated output or the maximum output such as, for example, by using the engine at an output a little lower than the maximum output.

In step S9 and step S10, a correction coefficient KL is computed at the correction coefficient computing unit 41*k*. The correction coefficient KL is a coefficient for correcting the total output demand equal to or smaller than the output threshold level for the engine 106. In the case of step S9, KL=1 is set as the total output demand has been determined to be equal to or smaller than the output threshold level of the engine 106. In the case of step S10, on the other hand, the correction coefficient KL<1 is computed as the total output demand has been determined to be greater than the output threshold level of the engine 106. KL is computed in step S9 or step S10, and the flow moves to step S11. Using the load pressure, total output demand, first target delivery flow rates and preset hydraulic pump efficiency values, the correction coefficient KL<1 is computed such that the total output demand falls within a range of deviations set beforehand with respect to the output threshold level.

In step S11 to step S13, the correction computation of the first target delivery flow rates, the correction computation of the total output demand, and the correction coefficient of the flow rate demand of each hydraulic actuator are performed, at the state amount correction computing unit 41*m*, according to the equations (2) to (4) shown in FIG. 30 by using the correction coefficients, respectively. After the computations according to the equations (2) to (4), the results of the computations are outputted to the outside. In the equations (2) to (4), QRCnj means each corrected first target flow rate, PWtC means the corrected total output demand, and QCn means the corrected total flow rate demand of each hydraulic actuator.

The control step at the second target delivery-flow-rate setting unit 41*d* will be described using FIG. 13.

Step S14 inputs, from step S13 in FIG. 12, the corrected first target flow rates, the corrected total output demand, the corrected total flow rate demand of each hydraulic actuator, and the like are inputted, and performs a determination under the determination conditions 1, that is, conducts a determination as to whether each corrected first target flow rate needs a correction.

As a reason for the inclusion of the determination of the need or non-need of the correction, when the correction is performed at the output limiting unit 41*c*, the correction coefficient KL<1 is equally multiplied to the respective first target output flow rates so that the first target flow rates decrease from their corresponding delivery flow rates at the preset efficiency values. Continuation of delivery from all the hydraulic pumps, as they are, involves a possibility that all the hydraulic pumps may be used with hydraulic pump efficiencies lower than the preset efficiency values. It is, therefore, desired to re-correct such that at least one hydraulic pump, which is high in the order of connection, delivers at its preset efficiency value to permit using it at as high an efficiency as possible. Accordingly, the flow advances to a control step of re-correction if a correction has been made. It is here that the determination of need or non-need of the correction is needed.

The control step under the determination conditions 1 in step S14 is illustrated in FIG. 14. In step S1401, the count number n of the hydraulic actuator(s) as target(s) of operation is initialized to 0. Further in step S1402, the count number n of the hydraulic actuator (s) as target(s) of operation is added by 1.

In step S1403, each corrected first target delivery flow rate and its corresponding flow rate at the preset hydraulic pump efficiency value are subjected to a comparative determination to determine the need or non-need of a correction. If the correction is not needed, the correction coefficient KL is 1 (KL=1) so that the corrected first target flow rate of the hydraulic pump, which has the first priority in the order of connection, is equal to the corresponding first target delivery flow rate, in other words, is equal to the corresponding delivery flow rate at the preset hydraulic pump efficiency value as computed in step S6. If the correction is needed, on the other hand, the correction coefficient KL<1 has been multiplied to each first target delivery flow rate so that the corrected first target delivery flow rate of the hydraulic pump, which has the first priority in the order of connection, is not equal to the corresponding first delivery flow rate at the preset hydraulic pump efficiency value. Based on the above-described differences, the need or non-need of the correction has been determined.

After performing the determination of the need or non-need of the correction under the determination conditions 1 in step S1403, the flow moves to step S1404 if the correction is not needed, or to step S1405 if the correction is needed.

If the count number n of hydraulic actuator(s) as target(s) of operation is determined to be equal to the number m of hydraulic actuator(s) as target(s) of operation in step S1404, the flow moves to step S15.

If the count number n of hydraulic actuator(s) as target (s) of operation is similarly determined to be equal to the number m of hydraulic actuator(s) as target(s) of operation in step S1405, the flow moves to step S16.

In step S15, the correction is not needed so that the first target delivery flow rate is outputted as a second target delivery flow rate to the outside. After the output, the flow moves to step S18, and returns again to step S1.

In step S16, the correction is needed so that the corrected first target delivery flow rate is re-corrected. The control step of step S16 is illustrated in FIG. 15.

The control process of step S16 illustrated in FIG. 15 is basically the same as the control process of step S6 illustrated in FIG. 10, and different steps are step S1605, step S1607, step S1609, step S1610 and step S1612.

Described specifically, step S1605 computes the delivery flow rates of the respective hydraulic pumps, which are at and can be connected to the hydraulic actuator as the target of operation, at their preset hydraulic pump efficiency values, determines their sum, and compares the sum with the corrected flow rate demand of the hydraulic actuator as the target of operation.

In step S1607, the count number j of the hydraulic pumps, which are to be connected in the above-described order to the hydraulic actuator as the target of operation, when the sum Σ(QEnj) of the delivery flow rates QEnj of the hydraulic pumps has become equal to or greater than the corrected flow rate demand QCn of the hydraulic actuator is stored as $t_n$, and the flow moves to step S1608.

In step S1609, the delivery flow rates QEnj of the hydraulic pumps, which at their preset hydraulic pump efficiency value and are connectable to the hydraulic actuator as the target of control, are repeatedly inputted as re-corrected first target delivery flow rates according to the order of connection until the count number j reaches $t_n-1=1$ in step S1610. When the count number j has reached $t_n-1=1$, the flow moves to step S1612. For the sake of convenience in description, each re-corrected first target delivery flow rate is represented by QR2*nj*.

Step S1612 illustrates a computation step that the sum Σ(QR2*nj*) of the re-corrected target delivery flow rates until the count number j=1 . . . ($t_n-1$) is subtracted from the corrected flow rate demand QCn of the hydraulic actuator as the target of operation to determine the margin as QR2*$nt_n$*. The margin QR2*$nt_n$* is determined, and the flow moves to step S1613.

In step S17, the re-corrected first target delivery flow rate is outputted as a second target delivery flow rate to the outside. After the output, the flow moves to step S18, and returns again to step S1.

If the total output demand is equal to or smaller than the output threshold level of the engine 106 and the correction is not needed, the second target delivery-flow-rate setting unit 41*d* outputs the first target delivery flow rates as second target delivery flow rates to the hydraulic regulators 3*a*-3*f* through the control step of step S15. If the total output demand exceeds the output threshold level of the engine 106 and the correction is needed, the re-corrected first target delivery flow rates which have been obtained by re-correcting the corrected first target delivery flow rates are outputted as second target delivery flow rates to the hydraulic regulators 3*a*-3*f* through the control step of step S16. As a consequence, an output limitation is applied at the output limiting unit 41*c*. Even when the first target delivery flow rates are corrected, their re-correction, for example, to the preset hydraulic pump efficiency values allows the hydraulic pumps, the order of connection of which is j=1 . . . ($t_n-1$), to deliver pressure oil at the original preset hydraulic pump efficiency values instead of the reduced hydraulic pump efficiencies as a result of the correction. The hydraulic pumps can, therefore, be driven in large capacity ranges of as high hydraulic pump efficiency as possible.

It is to be noted that the delivery flow rate of each of the above-described hydraulic pumps to be connected is computed at the hydraulic pump state amount computing unit 41*b* by using the capacity ratio at its preset efficiency value, its maximum capacity, and a rotational speed of the engine 106 as detected by an unillustrated rotational speed detection unit. Although not illustrated in any figure, the corrected total output demand can be used in a computation such as confirming that the corrected total output demand is smaller than the engine output threshold level or such as comparing the corrected total output demand with the re-corrected total output demand to determine the difference in output and increasing the flow rate of the hydraulic pump, which delivers the margin, by the difference in output.

A description will next be made about operations of the first embodiment.

Figure 16:
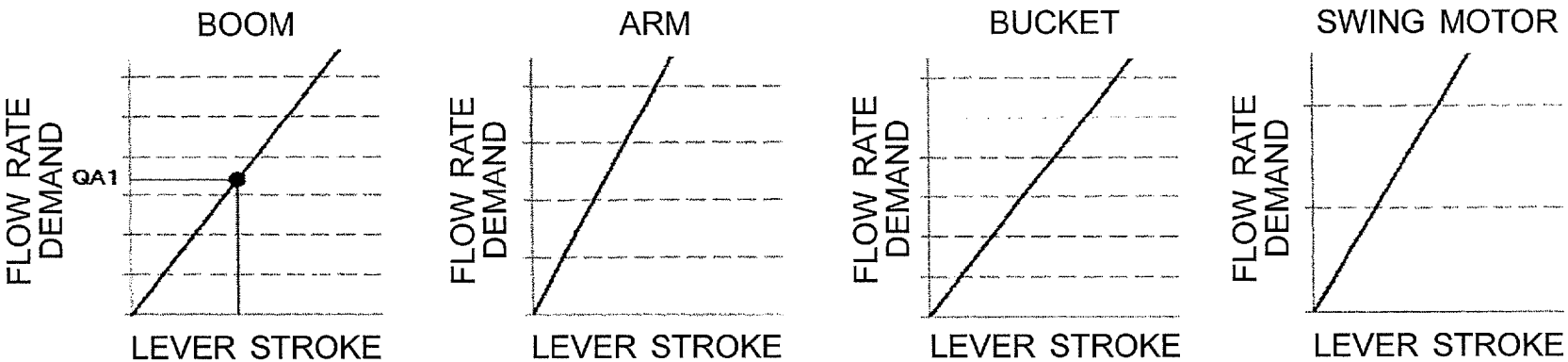
FIG. 16 shows diagrams, which illustrate a first operation example of the first embodiment of the driving device according to the present invention for the working machine as described with reference to the characteristic curve diagrams shown in FIG. 6.
Figure 18:
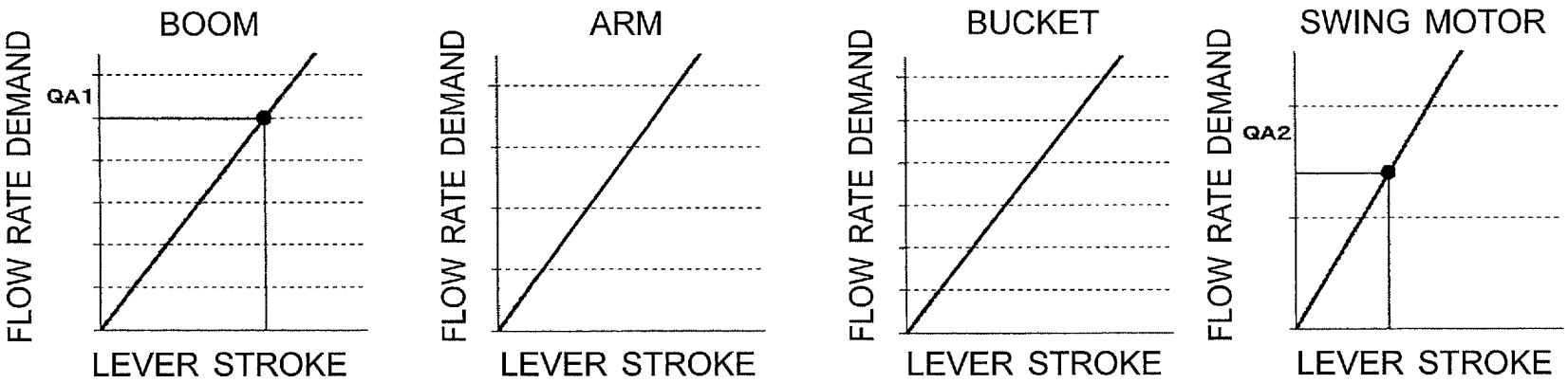
FIG. 18 shows diagrams, which illustrate a second operation example of the first embodiment of the driving device according to the present invention for the working machine as described with reference to the characteristic curve diagrams shown in FIG. 6.

FIG. 16 shows diagrams, which illustrate a first operation example of the first embodiment of the driving device according to the present invention for the working machine as described with reference to the characteristic curve diagrams shown in FIG. 6. FIG. 17 is a table illustrating the first operation example of the first embodiment of the driving device according to the present invention for the working machine as described with reference to the correlation table shown in FIG. 7. FIG. 18 shows diagrams, which illustrate a second operation example of the first embodiment of the driving device according to the present invention for the working machine as described with reference to the characteristic curve diagrams shown in FIG. 6. FIG. 19 is a table illustrating the second operation example of the first embodiment of the driving device according to the present invention for the working machine as described with reference to the correlation table shown in FIG. 7.

As a first operation example of the first embodiment, an operation example upon single operation of the boom cylinder 7*a* will be described using FIG. 16 and FIG. 17.

Now, the output threshold level PW1 of the engine 106 is set as a maximum output at 500 (kW) (PW1=500 (kW)), and the preset hydraulic pump efficiency value is always set at a maximum efficiency relative to a load pressure. The hydraulic actuator as a target of operation is the boom cylinder 7*a*, and a lever stroke corresponding to a flow rate demand QA1 of 1700 (L/min) at the time of a boom raising operation is inputted. Further, the load pressure ΔPL1 at this time is 12 (MPa) (ΔPL1=12 (MPa)), and the number m of hydraulic actuator(s) as target(s) of operation is 1 (m=1) because only the boom cylinder 7*a* is a target of operation. Among the variable displacement hydraulic pumps 2*a*-2*f*, the variable displacement hydraulic pumps 2*a*-2 and the variable displacement hydraulic pumps 2*a*,2*f* are different from each other in maximum capacity, and the maximum delivery flow rates of the variable displacement hydraulic pumps 2*a*-2*d* and those of the variable displacement hydraulic pumps 2*a*,2*f* are assumed to be 500 (L/min) and 400 (L/min), respectively, when the engine 106 is assumed to be operating at a given rotational speed. However, it is to be noted that the maximum capacity of each hydraulic pump, namely, the value of its maximum delivery flow rate is not limited to 500 (L/min) or 400 (L/min), and through the present invention, other values may be used or all the hydraulic pumps may have the same value. Throughout the present invention, the load pressure ΔPL1=12 (MPa) is not limited to this value either and other values may also be used. The hydraulic pump efficiency is the multiplication value of a volumetric efficiency and a mechanical efficiency of each hydraulic pump, but the hydraulic pump efficiency is set at 100% for a simpler description. The foregoing are adopted as conditions for the first operation example.

When a lever stroke which commands a raising operation of the boom cylinder 7*a* is inputted to the first target delivery-flow-rate setting unit 41*a* in the controller 41 from the control device 40*a*, the hydraulic actuator flow rate demand computing unit 41*e* in the first target delivery-flow-rate setting unit 41*a* outputs QA1=1700 (L/min) as a flow rate demand to the outside as depicted in FIG. 16. This control step corresponds to the above-mentioned step S1 to step S3.

The connection determining unit 41*f* in the first target delivery-flow-rate setting unit 41*a* computes plural ones of the variable displacement hydraulic pump 2*a*-2*f*, said plural hydraulic pumps being connectable to the boom cylinder 7*a* as the target of operation, and the order of their connection as 2*a*, 2*d*, 2*b*, 2*e*, 2*f* and 2*c* as indicated by parentheses in FIG. 17, and outputs them to the outside. This control step corresponds to the above-mentioned step S4.

At the hydraulic pump state amount computing unit 41*b*, the delivery flow rates of the hydraulic pumps, which are to be connected, at their preset efficiency values are computed to be 500 (L/min) for the variable displacement hydraulic pumps 2*a*-2*d* and 400 (L/min) for the variable displacement hydraulic pumps 2*e*, 2*f* according to the desired steps A to C in step S5, and are outputted to the outside. The preset hydraulic pump efficiency values are assumed to be the maximum efficiency of $Ps\eta_{1j}$=91(%) at the load pressure ΔPL1=12 (MPa).

The first target delivery flow rate computing unit 41*g* in the first target delivery-flow-rate setting unit 41*a* computes the first target delivery flow rates of the hydraulic pumps, which are to be connected to the boom cylinder 7*a*, according to step S6. As the first target delivery flow rates, the variable displacement hydraulic pumps 2*a*: $QR1_{11}$=500 (L/min), 2*d*: $QR1_{12}$=500 (L/min), 2*b*: $QR1_{13}$=500 (L/min) and 2*e*: $QR1_{14}$=200 (L/min) are obtained from the above-mentioned conditions for the first operation example, and are outputted to the outside.

When the first target delivery flow rates from the first target delivery-flow-rate setting unit 41*a* are inputted to the output limiting unit 41*c*, the output demand computing unit 41*h* computes the total output demand for the boom cylinder 7*a* according to step S7 by using the equation (1) shown in FIG. 30. As the results of the computation, $$PWt1=12\times(500/0.91+500/0.91+500/0.91+200/0.84)/60=377\ (\text{kW})$$

is obtained, and is outputted to the outside.

According to step S8, the output comparison unit 41*j* compares the total output demand PWt1 with the engine output threshold level PW1. From the above-mentioned conditions for the first operation example, the engine output threshold level PW1 is set at the maximum engine output of 500 (kW) (PW1=500 (kW)) at the prime mover output setting unit 41*i*. As a result of the comparison between the total output demand and PW1, PWt1=377 (kW)<PW1=500 (kW) is obtained, namely, the engine output threshold level is determined to be greater, and the result of this determination is outputted to the outside.

As the engine output threshold level has been determined to be greater than the total output demand in step S8, the flow moves to step S9. According to step S9, the correction coefficient computing unit 41*k* computes the correction coefficient KL=1, and outputs it to the outside.

According to step S11 to step S13, the state amount correction computing unit 41*m* performs the correction computation of the total output demand, the correction computation of the first target delivery flow rates, and the correction computation of the flow rate demand of the boom cylinder 7*a* by using the equations (2) to (4) shown in FIG. 30. Obtained as the results of these computations are: from the equation (2), $$QRC_{11}=QRC_{12}=QRC_{13}=500\times1=500\ (\text{L/min})$$

$$QRC_{14}=200\times1=200\ (\text{L/min})$$

from the equation (3), $$PWtC=12\times(500/0.91+500/0.91+500/0.91+200/0.84)/60=377\ (\text{kW})$$

from the equation (4), $$QC_1=(500+500+500+200)=1700\ (\text{L/min}),$$

and these results are outputted to the outside.

Upon input of the corrected first target delivery flow rates and the like, the second target delivery-flow-rate setting unit 41*d* performs the determination under the determination conditions 1 according to step S14. As the corrected first target delivery flow rates $QRC_{11}$=the corresponding first target delivery flow rates $QR1_{11}$, the corrected first target delivery flow rates are determined to be equal to the corresponding first target delivery flow rates, and the flow moves to step S15.

In step S15, the second target flow rates are computed to be equal to the corresponding first target flow rates. Therefore, $$QR2_{11}=QR1_{11}=500\ (\text{L/min})$$

$$QR2_{12}=QR1_{12}=500\ (\text{L/min})$$

$$QR2_{13}=QR1_{13}=500\ (\text{L/min})$$

$$QR2_{14}=QR1_{14}=200\ (\text{L/min})$$

are obtained, and these second target delivery flow rates are outputted as target values of the hydraulic pumps to the hydraulic regulators 3*a*, 3*d*, 3*b* and 3*e*, respectively.

A description will next be made about a case that in the first operation example, the load pressure ΔPL1 is 20 (MPa) (ΔPL1=20 (MPa)) among the above-mentioned conditions for the first operation example.

The first target delivery flow rates $QR1_{11}$ to $QR1_{13}$=500 (L/min) and the preset hydraulic pump efficiency value $Ps\eta_{1j}$=91(%) set by the first target delivery-flow-rate setting unit 41*a* are not different from those when the load pressure ΔPL1=12 (MPa), the description is omitted about the control step at the first target delivery-flow-rate setting unit 41*a*.

When the first target delivery flow rates from the first target delivery-flow-rate setting unit 41*a* are inputted to the output limiting unit 41*c*, the output demand computing unit 41*h* computes the total output demand for the boom cylinder 7*a* according to step S7 by using the equation (1) shown in FIG. 30. As the results of the computation, $$PWt1=20\times(500/0.91+500/0.91+500/0.91+200/0.84)/60=629\ (\text{kW})$$

is obtained, and is outputted to the outside.

According to step S8, the output comparison unit 41*j* compares the total output demand PWt1 with the engine output threshold level PW1. As a result of the comparison between the total output demand and PW1, PWt1=629 (kW)>PW1=500 (kW) is obtained, namely, the total output demand is determined to be greater, and the result of this determination is outputted to the outside.

As the total output demand has been determined to be greater than the engine output threshold level in step S8, the flow moves to step S10. According to step S10, the correction coefficient computing unit 41*k* computes the correction coefficient KL=0.78, and outputs it to the outside.

According to step S11 to step S13, the state amount correction computing unit 41*m* performs the correction computation of the total output demand, the correction computation of the first target delivery flow rates, and the correction computation of the flow rate demand of the boom cylinder 7*a* by using the equations (2) to (4) shown in FIG. 30. Obtained as the results of these computations are: from the equation (2), $$QRC_{11}=QRC_{12}=QRC_{13}=500\times0.78=390\ (\text{L/min})$$

$$QRC_{14}=200\times1=156\ (\text{L/min})$$

from the equation (3), $$PWtC = 20 \times (390/0.9 + 390/0.9 + 390/0.9 + 156/0.8)/60$$
$$= 498 \text{ (kW)}$$

It is, therefore, possible to confirm that the corrected total output demand is smaller than the engine output threshold level PW1=500 (kW).

In addition, from the equation (4), $$QC_1=(390+390+390+156)=1326 \text{ (L/min)},$$

and these results are outputted to the outside.

Upon input of the corrected first target delivery flow rates and the like, the second target delivery-flow-rate setting unit 41*d* performs the determination under the determination conditions 1 according to step S14. As the corrected first target delivery flow rates $QRC_{11} \neq$the corresponding first target delivery flow rates $QR1_{11}$, the corrected first target delivery flow rates are determined to be unequal to the corresponding first target delivery flow rates, and the flow moves to step S16.

In step S16, the re-correction computation of the corrected first target delivery flow rates is performed, and the step moves to step S17, where the second target flow rates are computed to be equal to the corresponding re-corrected first target flow rates. Therefore, $$QR2_{11}=500 \text{ (L/min)}$$

$$QR2_{12}=500 \text{ (L/min)}$$

$$QR2_{13}=326 \text{ (L/min)}$$

are obtained, and the variable displacement hydraulic pumps 2*a*,2*d* are re-corrected to the preset hydraulic pump efficiency values, in other words, the maximum efficiencies. These second target delivery flow rates are outputted as target values of the hydraulic pumps to the hydraulic regulators 3*a*, 3*d* and 3*b*, respectively. It is to be noted that from these results, the variable displacement hydraulic pump 2*e* is excluded from the target hydraulic pumps to be connected.

Here, the re-corrected total output demand PWt2 is determined.

$$PWt2 = 20 \times (500/0.91 + 500/0.91 + 326/0.9)/60$$
$$= 487 \text{ (kW)}$$

is obtained. The output demand can be further decreased by 11 (kW) from the corrected total output demand PWtC=498 (kW), and therefore the energy saving effect can be increased. If it is desired to achieve a greater amount of work, control may be added such that this difference is applied to the variable displacement hydraulic pump 2*b*, from which the margin is delivered, to increase its delivery flow rate.

As a second operation example of the first embodiment, an operation example upon combined operation of the boom cylinder 7*a* and swing motor 10*c* will next be described using FIG. 18 and FIG. 19.

As conditions for the second operation example, only those which are different from the conditions for the first operation example will hereinafter be described. The hydraulic actuators as targets of operation are the boom cylinder 7*a* and swing motor 10*c*, and lever strokes corresponding to a flow rate demand QA1 of 2500 (L/min) for a boom raising operation and a flow rate demand QA2 of 700 (L/min) for a leftward swing operation are inputted, respectively. At this time, the load pressure ΔPL1 on the boom cylinder 7*a* is 9 (MPa) (ΔPL1=9 (MPa)), the load pressure ΔPL2 on the swing motor is 9 (MPa) (APL2=9 (MPa)), the number m of the hydraulic actuators as the targets of operation is 2 (m=2) because the boom cylinder 7*a* and swing motor 10*c* are operated, and the count numbers n=1 and n=2 of the respective hydraulic motors as the targets of operation are assumed to be the boom cylinder 7*a* and swing motor 10*c*, respectively. The remaining conditions are the same as the corresponding ones in the conditions for the first operation example.

When a lever stroke which commands the raising operation of the boom cylinder 7*a* is inputted to the first target delivery-flow-rate setting unit 41*a* in the controller 41 from the control device 40*a*, the hydraulic actuator flow rate demand computing unit 41*e* in the first target delivery-flow-rate setting unit 41*a* outputs QA1=2500 (L/min) as a flow rate demand to the outside as depicted in FIG. 18.

When a lever stroke which commands the leftward swing operation of the swing motor 10*c* is inputted from the control device 40*b*, the hydraulic actuator flow rate demand computing unit 41*e* in the first target delivery-flow-rate setting unit 41*a* outputs QA2=700 (L/min) as a flow rate demand to the outside as depicted in FIG. 18. These control steps correspond to the above-mentioned step S1 to step S3.

As indicated by parentheses in FIG. 19, the connection determining unit 41*f* in the first target delivery-flow-rate setting unit 41*a* computes plural ones of the variable displacement hydraulic pumps 2*a*-2*f*, said plural hydraulic pumps being connectable to the boom cylinder 7*a* as the target of operation, and the order of their connection as 2*a*, 2*d*, 2*b*, and 2*c*, and also computes the hydraulic pumps, which are connectable to the swing motor 10*c* as the target of operation, and the order of their connection as 2*e* and 2*f*, and outputs them to the outside. These control steps correspond to the above-mentioned step S4.

At the hydraulic pump state amount computing unit 41*b*, the delivery flow rates of the hydraulic pumps, which are to be connected, at their preset efficiency values are computed to be 500 (L/min) for the variable displacement hydraulic pumps 2*a*-2*d* and 400 (L/min) for the variable displacement hydraulic pumps 2*e*, 2*f* according to the desired steps A to C in step S5, and are outputted to the outside. The preset hydraulic pump efficiency values are assumed to be the maximum efficiency of $Ps\eta_{1j}$=90(%) at the load pressure ΔPL1=ΔPL2=9 (MPa).

The first target delivery flow rate computing unit 41*g* in the first target delivery-flow-rate setting unit 41*a* computes the first target delivery flow rates of the hydraulic pumps, which are to be connected to the boom cylinder 7*a* and swing motor 10*c*, according to step S6. Obtained as the first target delivery flow rates from the above-mentioned conditions are the variable displacement hydraulic pumps 2*a*: $QR1_{11}$=500 (L/min), 2*d*: $QR1_{12}$=500 (L/min), 2*b*: $QR1_{13}$=500 (L/min) and 2*e*: $QR1_{14}$=500 (L/min) for the boom cylinder 7*a* and the variable displacement hydraulic pumps 2*e*: $QR1_{21}$=400 (L/min) and 2*d*: $QR1_{22}$=300 (L/min) for the swing motor 10*c*, and these first target delivery flow rates are outputted to the outside.

When the first target delivery flow rates from the first target delivery-flow-rate setting unit 41*a* are inputted to the output limiting unit 41*c*, the output demand computing unit 41*h* computes the total output demand for the boom cylinder 7*a* and swing motor 10*c* according to step S7 by using the equation (1) shown in FIG. 30. As the results of the computation, $$PWt1 = 9\times(500/0.9+500/0.9+500/0.9+500/0.9)/60+ 9\times(400/0.9+300/0.88/60 = 451\ (\text{kW})$$

is obtained, and is outputted to the outside.

According to step S8, the output comparison unit 41*j* compares the total output demand PWt1 with the engine output threshold level PW1. As a result of the comparison between the total output demand and PW1, PWt1=451 (kW)<PW1=500 (kW) is obtained, namely, the engine output threshold level is determined to be greater, and the result of this determination is outputted to the outside.

As the engine output threshold level has been determined to be greater than the total output demand in step S8, the flow moves to step S9. According to step S9, the correction coefficient computing unit 41*k* computes the correction coefficient KL=1, and outputs it to the outside.

According to step S11 to step S13, the state amount correction computing unit 41*m* performs the correction computation of the total output demand, the correction computation of the first target delivery flow rates, and the correction computation of the flow rate demand of the boom cylinder 7*a* by using the equations (2) to (4) shown in FIG. 30. Obtained as the results of these computations are: from the equation (2), $$QRC_{11}=QRC_{12}=QRC_{13}=QRC_{14}=500\times1=500\ (\text{L/min})$$

$$QRC_{21}=400\times1=400\ (\text{L/min})$$

$$QRC_{22}=300\times1=300\ (\text{L/min})$$

from the equation (3), $$PWtC = 9\times(500/0.9+500/0.9+500/0.9+500/0.9)/60+ 500/0.9)/60+9\times(400/0.9+300/0.88)/60 = 451\ (\text{kW})$$

from the equation (4), $$QC_1=(500+500+500+500)=2000\ (\text{L/min})$$

$$QC_2=(400+300)=700\ (\text{L/min}),$$

and these results are outputted to the outside.

Upon input of the corrected first target delivery flow rates and the like, the second target delivery-flow-rate setting unit 41*d* performs the determination under the determination conditions 1 according to step S14. As the corrected first target delivery flow rates $QRC_{11}$=the corresponding first target delivery flow rates $QR1_{11}$ for the boom cylinder 7*a* and the corrected first target delivery flow rates $QR1_{21}$=the corresponding first target delivery flow rates $QR1_{21}$ for the swing motor 10*c*, these corrected first target delivery flow rates are determined to be equal to the corresponding first target delivery flow rates, and the flow moves to step S15.

In step S15, the second target flow rates are computed to be equal to the corresponding first target flow rates. Therefore, for the boom cylinder 7*a*, $$QR2_{11}=QR1_{11}=500\ (\text{L/min})$$

$$QR2_{12}=QR1_{12}=500\ (\text{L/min})$$

$$QR2_{13}=QR1_{13}=500\ (\text{L/min})$$

$$QR2_{14}=QR1_{14}=500\ (\text{L/min})$$

for the swing motor 10*c*, $$QR2_{21}=QR1_{21}=400\ (\text{L/min})$$

$$QR2_{22}=QR1_{22}=200\ (\text{L/min})$$

are obtained, and these second target delivery flow rates are outputted as target values of the hydraulic pumps to the hydraulic regulators 3*a*-3*f*, respectively.

A case will next be assumed that in the second operation example, the load pressure ΔPL1 on the boom cylinder 7*a* is 25 (MPa) (ΔPL1=25 (MPa)) and the load pressure ΔPL2 on the swing motor 10*c* is 20 (MPa) (ΔPL2=20 (MPa)) among the above-mentioned conditions for the second operation example.

In the case of the load pressure ΔPL1 on the boom cylinder 7*a*=25 (MPa) and the load pressure ΔPL2 on the swing motor 10*c*=20 (MPa) relative to the case of the load pressure ΔPL1=APL2=9 (MPa), the preset hydraulic pump efficiency value $Ps\eta_{1j}$ is 91% ($Ps\eta_{1j}$=91(%)) as set to give the maximum efficiency. The first target delivery flow rates, however, remain unchanged so that the description is omitted about the control step at the first target delivery-flow-rate setting unit 41*a*.

When the first target delivery flow rates from the first target delivery-flow-rate setting unit 41*a* are inputted to the output limiting unit 41*c*, the output demand computing unit 41*h* computes the total output demands for the boom cylinder 7*a* and swing motor 10*c* according to step S7 by using the equation (1) shown in FIG. 30. As the results of the computation, $$PWt1 = 25\times(500/0.91+500/0.91+500/0.91+500/0.91)/60+ 20\times(400/0.91+300/0.89)/60 = 1188\ (\text{kW})$$

is obtained, and is outputted to the outside.

According to step S8, the output comparison unit 41*j* compares the total output demand PWt1 with the engine output threshold level PW1. As a result of the comparison between the total output demand and PW1, PWt1=1188 (kW)>PW1=500 (kW) is obtained, namely, the total output demand is determined to be greater, and the result of this determination is outputted to the outside.

As the total output demand has been determined to be greater than the engine output threshold level in step S8, the flow moves to step S10. According to step S10, the correction coefficient computing unit 41*k* computes the correction coefficient KL=0.36, and outputs it to the outside.

According to step S11 to step S13, the state amount correction computing unit 41*m* performs the correction computation of the total output demand, the correction computation of the first target delivery flow rates, and the correction computation of the flow rate demand of the boom cylinder 7*a* by using the equations (2) to (4) shown in FIG. 30. Obtained as the results of these computations are: from the equation (2), $QRC_{11}=QRC_{12}=QRC_{13}=QRC_{14}=500\times0.36=180$ (L/min)

$QRC_{21}=400\times0.36=144$ (L/min)

$QRC_{22}=300\times0.36=108$ (L/min)

from the equation (3), $$PWtC = 25\times(180/0.78+180/0.78+180/0.78+180/0.78)/60+20\times(144/0.78+108/0.72)/60 = 496\ (\text{kW})$$

It is, therefore, possible to confirm that the corrected total output demand is smaller than the engine output threshold level PW1=500 (kW).

In addition, from the equation (4), $QC_1=(180+180+180+180)=720$ (L/min)

$QC_2=(144+108)=252$ (L/min), and these results are outputted to the outside.

Upon input of the corrected first target delivery flow rates and the like, the second target delivery-flow-rate setting unit 41*d* performs the determination under the determination conditions 1 according to step S14. As the corrected first target delivery flow rates $QRC_{11}\neq$the corresponding first target delivery flow rates $QR1_{11}$ and the corrected first target delivery flow rates $QRC_{21}\neq$the corresponding first target delivery flow rates $QR1_{21}$, these corrected first target delivery flow rates are determined to be unequal to the corresponding first target delivery flow rates, and the flow moves to step S16.

In step S16, the re-correction computation of the corrected first target delivery flow rates is performed, and the flow moves to step S17, where the second target flow rates are computed to be equal to the corresponding re-corrected first target flow rates. Therefore, $QR2_{11}=500$ (L/min)

$QR2_{12}=500$ (L/min)

$QR2_{21}=252$ (L/min)

are obtained, and the variable displacement hydraulic pump 2*a* is re-corrected to the preset hydraulic pump efficiency value, in other words, the maximum efficiency. These second target delivery flow rates are outputted as target values of the hydraulic pumps to the hydraulic regulators 3*a*, 3*d* and 3*e*, respectively. It is to be noted that from these results, the variable displacement hydraulic pumps 2*b*,2*c*,2*f* are excluded from the target hydraulic pumps to be connected.

Here, the re-corrected total output demand PWt2 is determined.

$$PWt2 = 25\times(500/0.91+220/0.81)/60+20\times(252/0.88)/60 = 438\ (\text{kW})$$

is obtained. The output demand can be further decreased substantially by 55 (kW) from the corrected total output demand PWtC=493 (kW), and therefore the energy saving effect can be increased. If it is desired to achieve a greater amount of work, control may be added such that this difference is applied to the variable displacement hydraulic pump 2*b*, from which the margin is delivered, to increase its delivery flow rate.

By this embodiment configured as described above, hydraulic pumps can be driven in large capacity ranges of as high a hydraulic efficiency as possible although their drive in such large capacity ranges have not been considered conventionally. As a result, the present invention makes it possible to provide a closed hydraulic circuit system with further improved efficiency.

Figure 20:
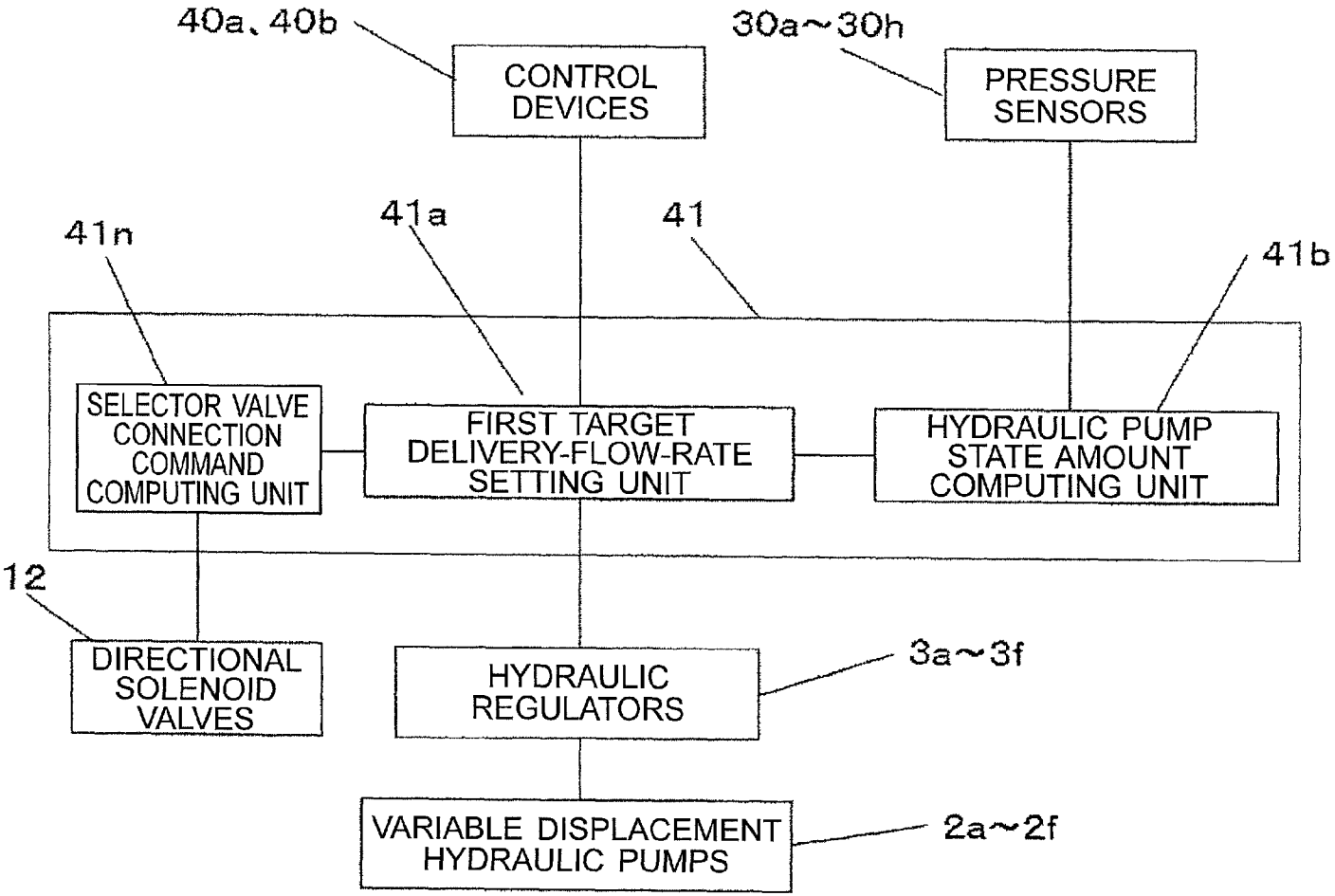
FIG. 20 is a diagram depicting an essential part of a controller provided in a second embodiment of the driving device according to the present invention for the working machine.

FIG. 20 is a diagram depicting an essential part of a controller 41 provided in a second embodiment of the driving device according to the present invention for the working machine.

A description is omitted about the elements of the same reference numerals as in the first embodiment.

If there is an extra output from the engine 106 relative to the total load on the respective hydraulic actuators, the output limiting unit 41*c* and second target delivery-flow-rate setting unit 41*d* become no longer needed. The second embodiment has taken such a case into consideration, and as depicted in FIG. 20, the first target delivery-flow-rate setting unit 41*a* is configured such that first target flow rates are computed and are outputted directly to the selector valve connection command computing unit 41*n* and hydraulic regulators 3*a*-3*f* as in the first embodiment.

This embodiment configured as described above can bring about similar effects as the first embodiment, and moreover can simplify control steps.

Figure 21:
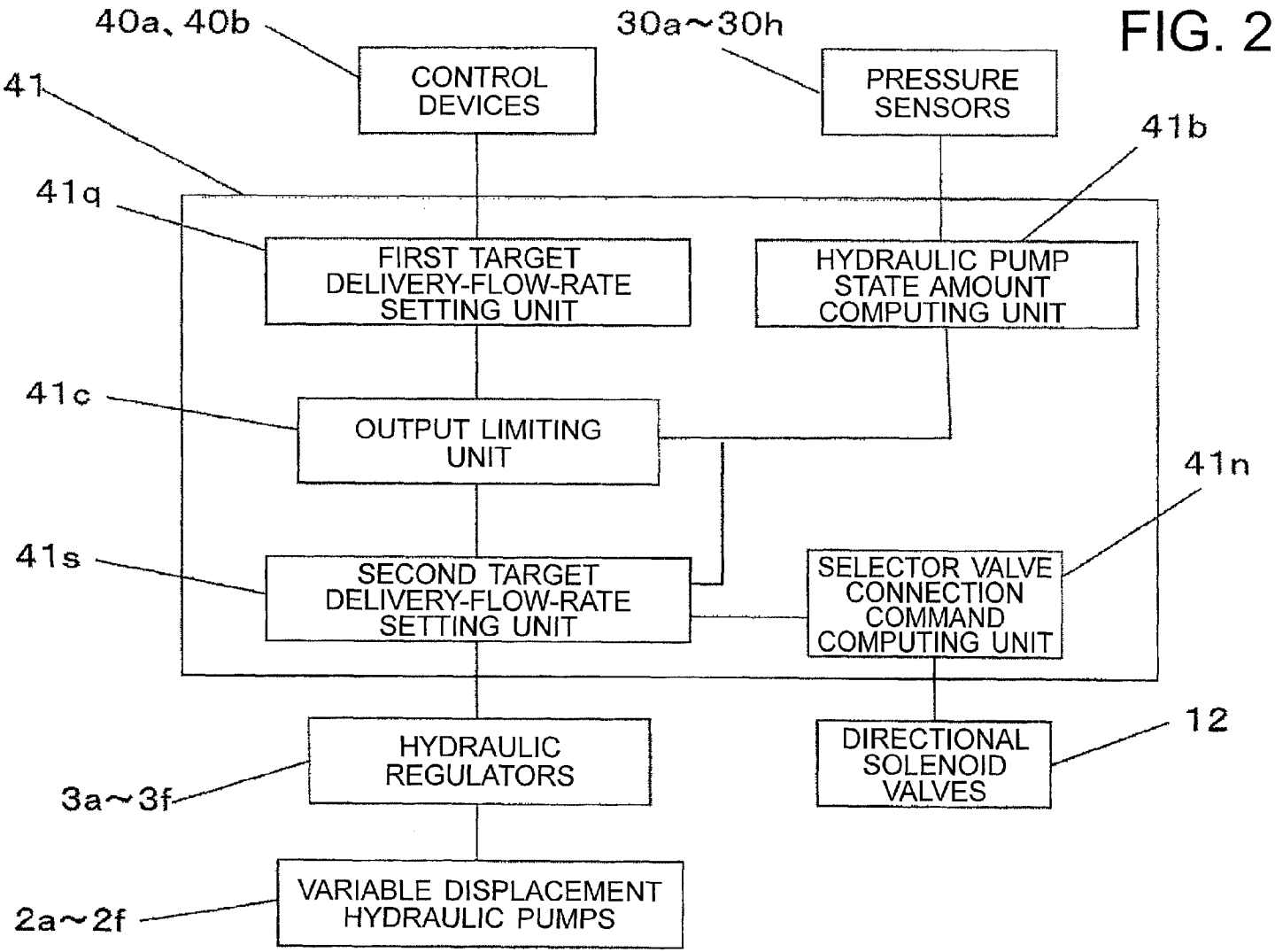
FIG. 21 is a diagram depicting an essential part of a controller provided in a third embodiment of the driving device according to the present invention for the working machine.

FIG. 21 is a diagram depicting an essential part of a controller 41 provided in a third embodiment of the driving device according to the present invention for the working machine.

A description is omitted about the elements of the same reference numerals as in the first embodiment.

The variable displacement hydraulic pumps 2*a*-2*f* all have the same maximum capacity and, if all the hydraulic pump preset efficiency values are fixedly set at the same value, the delivery flow rates of two or more connected ones of the hydraulic pumps equally take the fixed value at the preset efficiency value. The control steps of the desired steps A to C at the hydraulic pump state amount computing unit 41*b* can be omitted accordingly.

As depicted in FIG. 21, because of the fixed setting of all the preset hydraulic pump efficiency values at the same value, for example, the maximum efficiency, a first target delivery-flow-rate setting unit 41*q* and a second target delivery-flow-rate setting unit 41*s* are, provided in place of the first target delivery-flow-rate setting unit 41*a* and second target delivery-flow-rate setting unit 41*d* unlike the first embodiment. In addition, neither inputs nor outputs are directly made between the first target delivery-flow-rate setting unit 41*q* and the hydraulic pump state amount computing unit 41*b*.

Figure 22:
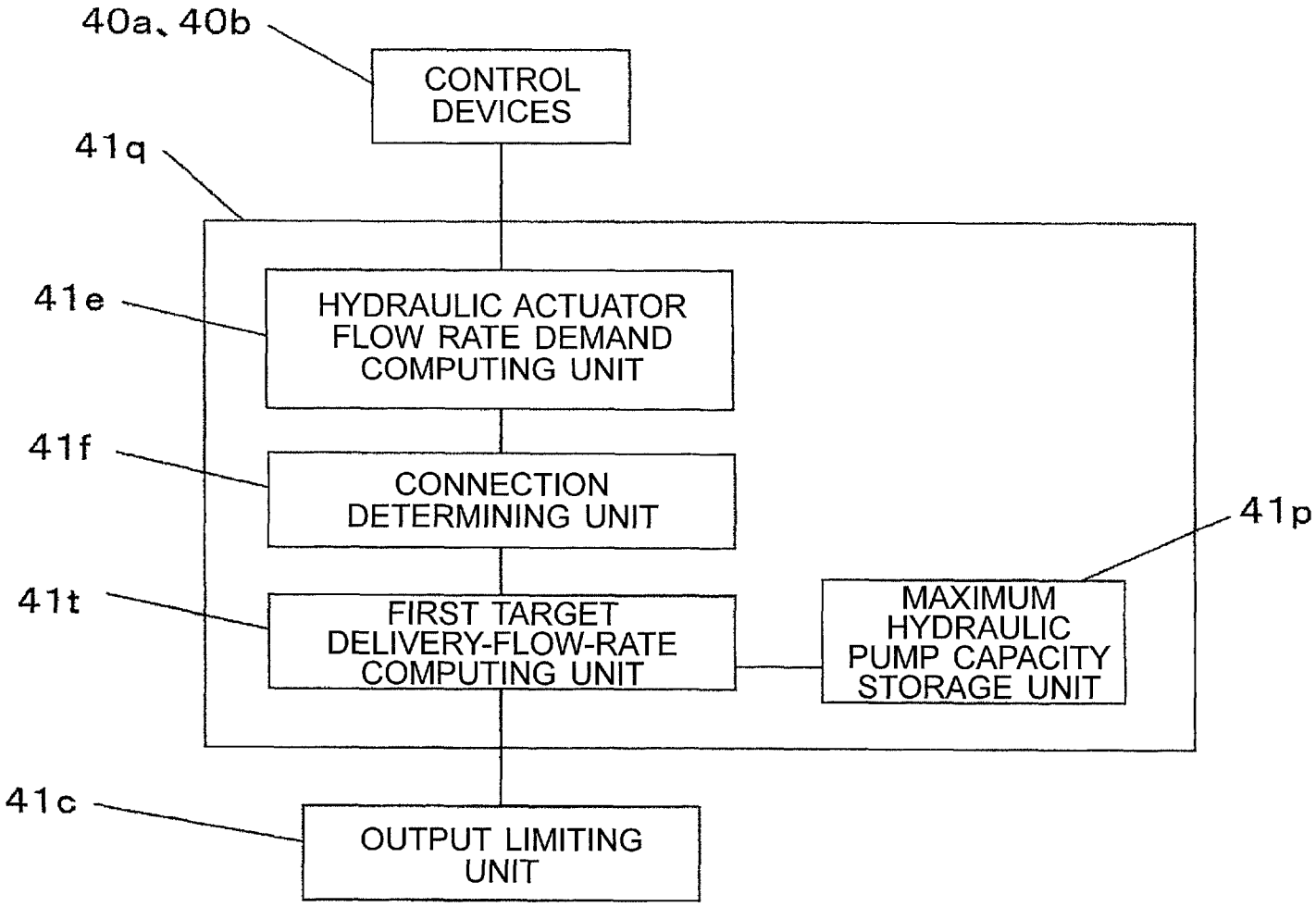
FIG. 22 is a diagram depicting an essential part of a first target delivery-flow-rate setting unit provided in the controller depicted in FIG. 21.
Figure 23:
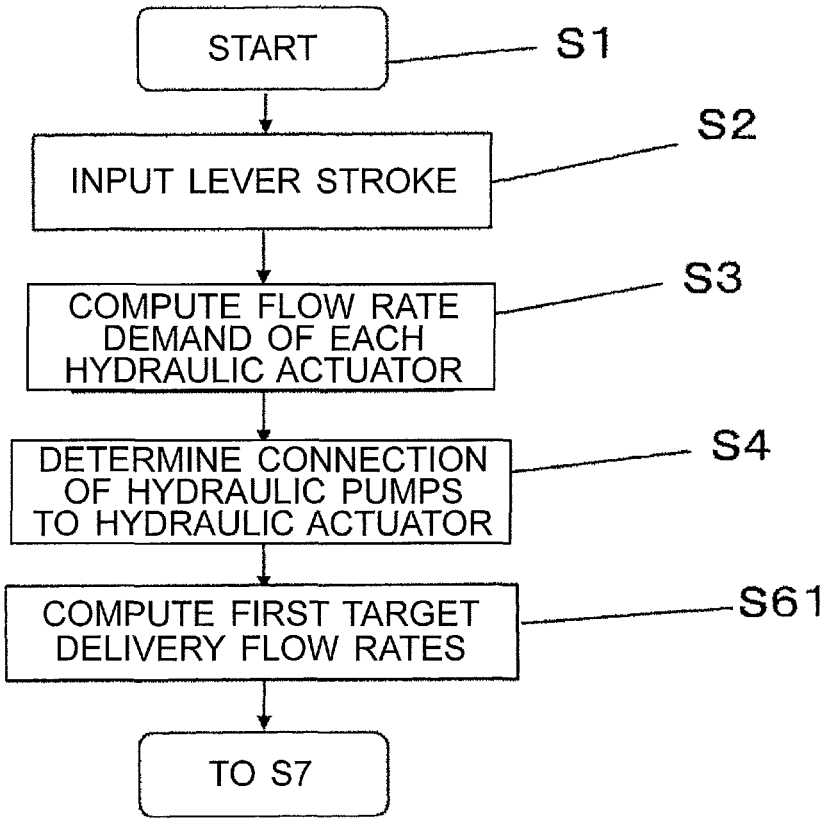
FIG. 23 is a flow chart diagram illustrating a control step at the first target delivery-flow-rate setting unit depicted in FIG. 22.
Figure 24:
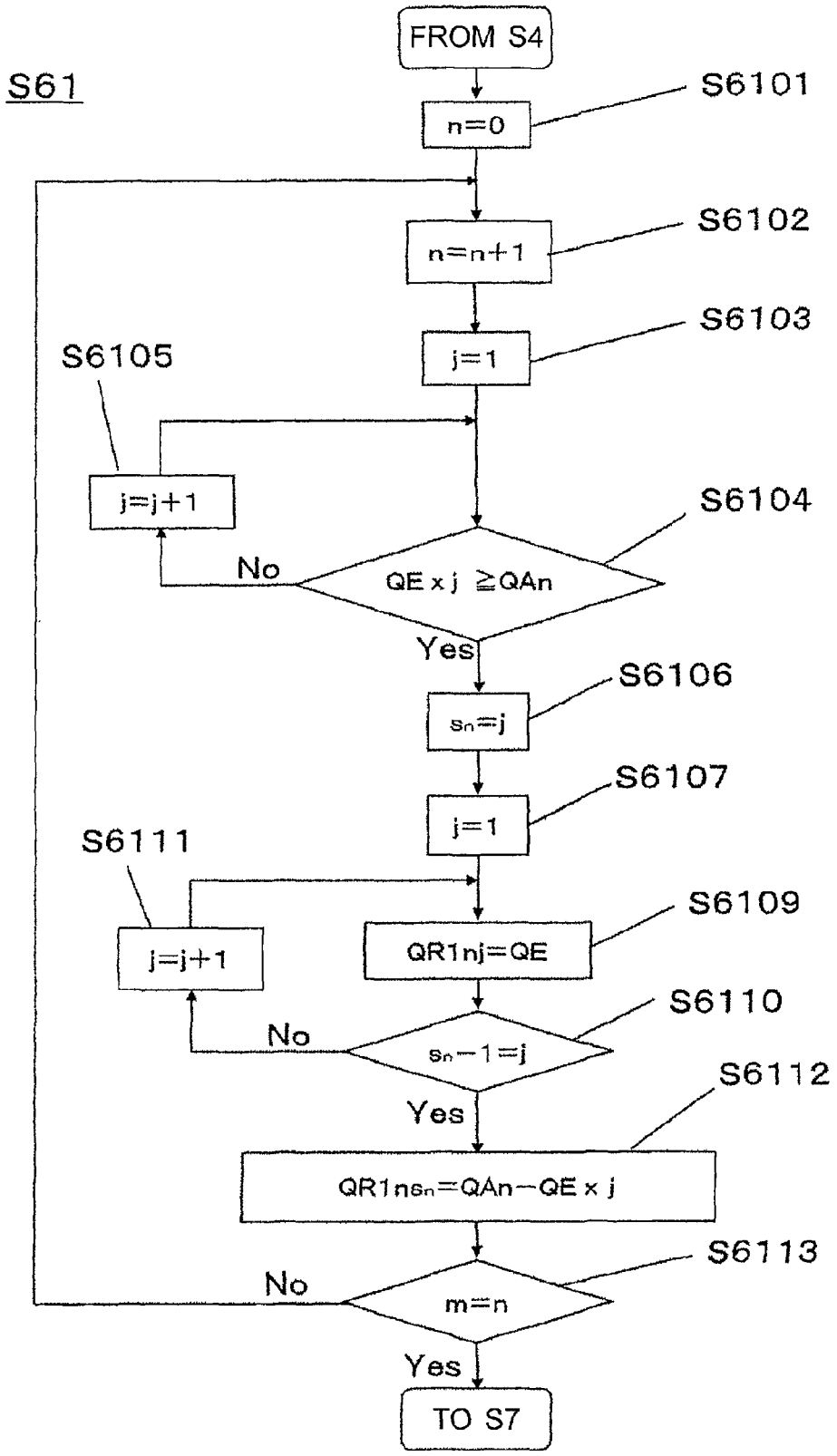
FIG. 24 is a flow chart diagram illustrating the processing in step S61 illustrated in FIG. 23, specifically a control step at the first target delivery-flow-rate computing unit.
Figure 25:
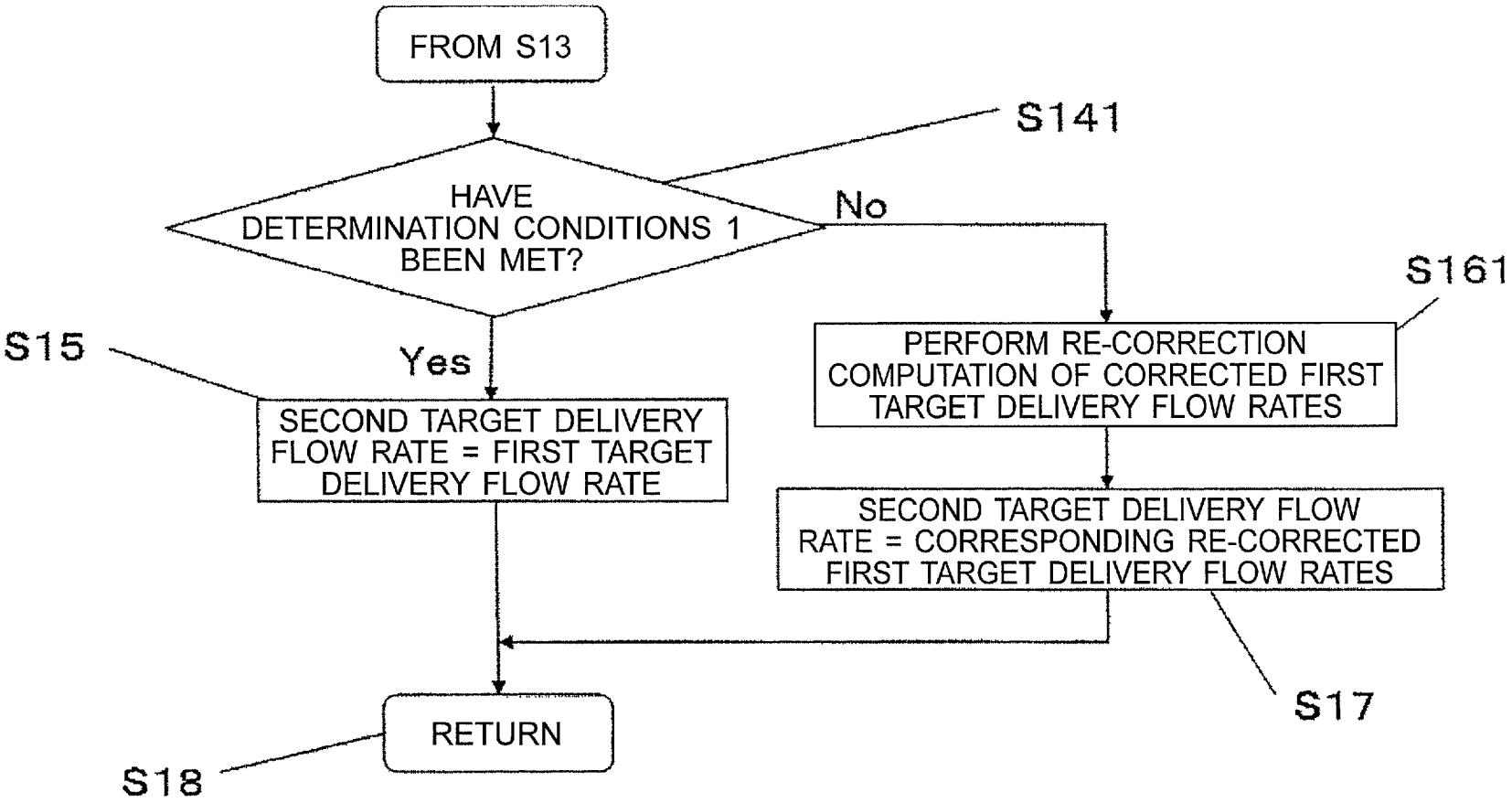
FIG. 25 is a flow chart diagram illustrating a control step at a second target delivery-flow-rate setting unit provided in the third embodiment of the driving device according to the present invention for the working machine.
Figure 26:
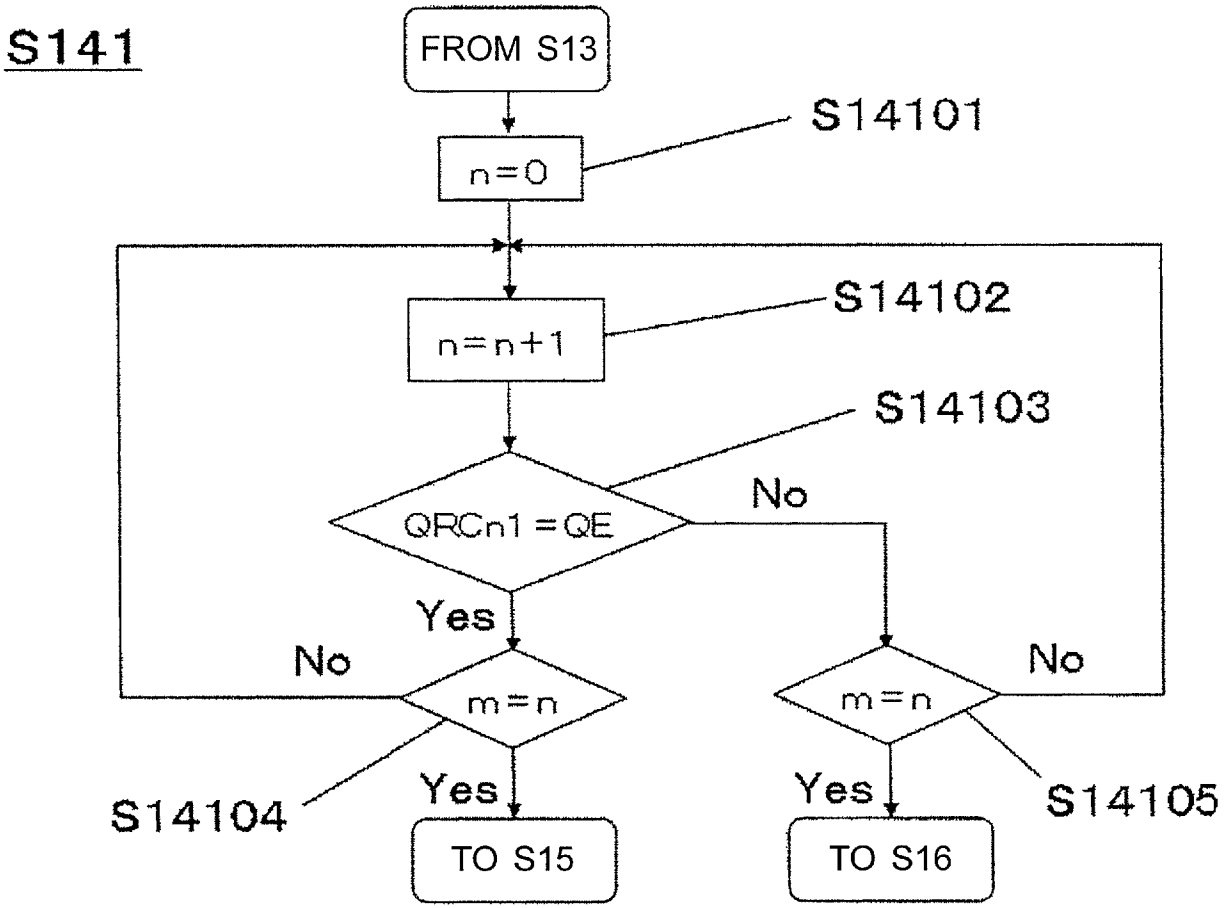
FIG. 26 is a flow chart diagram illustrating the processing in step S141 depicted in FIG. 25, specifically a control step under determination conditions 1.

FIG. 22 is a diagram depicting an essential part of the first target delivery-flow-rate setting unit 41*q* provided in the controller depicted in FIG. 21. FIG. 23 is a flow chart diagram illustrating a control step at the first target delivery-flow-rate setting unit 41*q* depicted in FIG. 22. FIG. 24 is a flow chart diagram illustrating the processing in step S61 illustrated in FIG. 23, specifically a control step at the first target delivery-flow-rate computing unit. FIG. 25 is a flow chart diagram illustrating a control step at the second target delivery-flow-rate setting unit 41*s* provided in the third embodiment of the driving device according to the present invention for the working machine. FIG. 26 is a flow chart diagram illustrating the processing in step S161 depicted in FIG. 25, specifically a control step for the computation of a second target delivery flow rate.

As depicted in FIG. 22, the first target flow-delivery flow rate setting unit 41*q* is provided with a first target delivery flow rate computing unit 41*t*, and further, step S61 is included instead of step S6 in the control step at the first target delivery-flow-rate setting unit 41*q* as depicted in FIG. 23.

Because of the fixed setting of the preset hydraulic pump efficiency value, the desired steps A to C at the hydraulic pump state amount computing unit 41*b* are performed in the steps of step S6103 to step S6104, and the step that computes the delivery flow rates of the connected hydraulic pumps at their corresponding preset efficiency values is eliminated. As a result, in steps S6104, step S6109 and step S6112, the delivery flow rate at the maximum efficiency is used as a fixed value QE without separately computing the delivery flow rates of the connected hydraulic pumps at their corresponding preset hydraulic pump efficiency values for every hydraulic actuator and for every hydraulic pump.

The second target delivery-flow-rate setting unit 41*s* is also configured likewise.

In the control step at the second target delivery-flow-rate setting unit 41*s* as illustrated in FIG. 25, step S141 and step S161 are included instead of step 14 and step S16.

As illustrated in FIG. 26, the control step of step S141 uses the fixed value QE, which is the delivery flow rate at the maximum efficiency, as the delivery flow rate of each connected hydraulic pump at the preset hydraulic pump efficiency value in step S14103.

Figure 27:
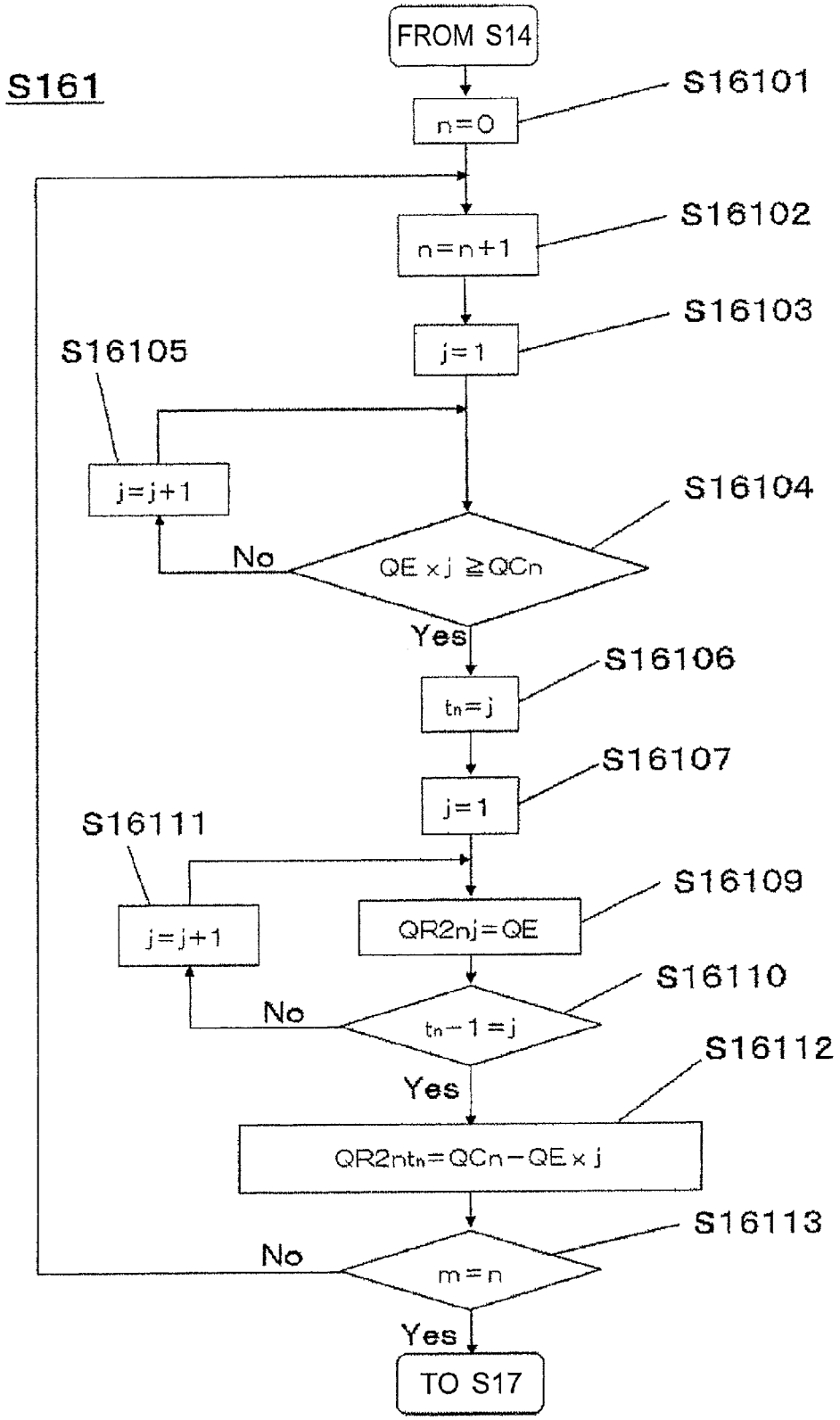
FIG. 27 is a flow chart diagram illustrating the processing in step S161 illustrated in FIG. 25, specifically a control step for the computation of a second target delivery flow rate.

As illustrated in FIG. 27, the desired steps A to C at the hydraulic pump state amount computing unit 41*b* are performed in the steps of step S16103 to step S16104, and the step that computes the delivery flow rates of the connected hydraulic pumps at their corresponding preset efficiency values is eliminated. As a result, in steps S16104, step S16109 and step S16112, the delivery flow rate at the maximum efficiency is used as the fixed value QE without separately computing the delivery flow rates of the connected hydraulic pumps at their corresponding preset hydraulic pump efficiency values for every hydraulic actuator and for every hydraulic pump.

This embodiment configured as described above can bring about similar effects as the first embodiment, and moreover can simplify control steps.

Figure 28:
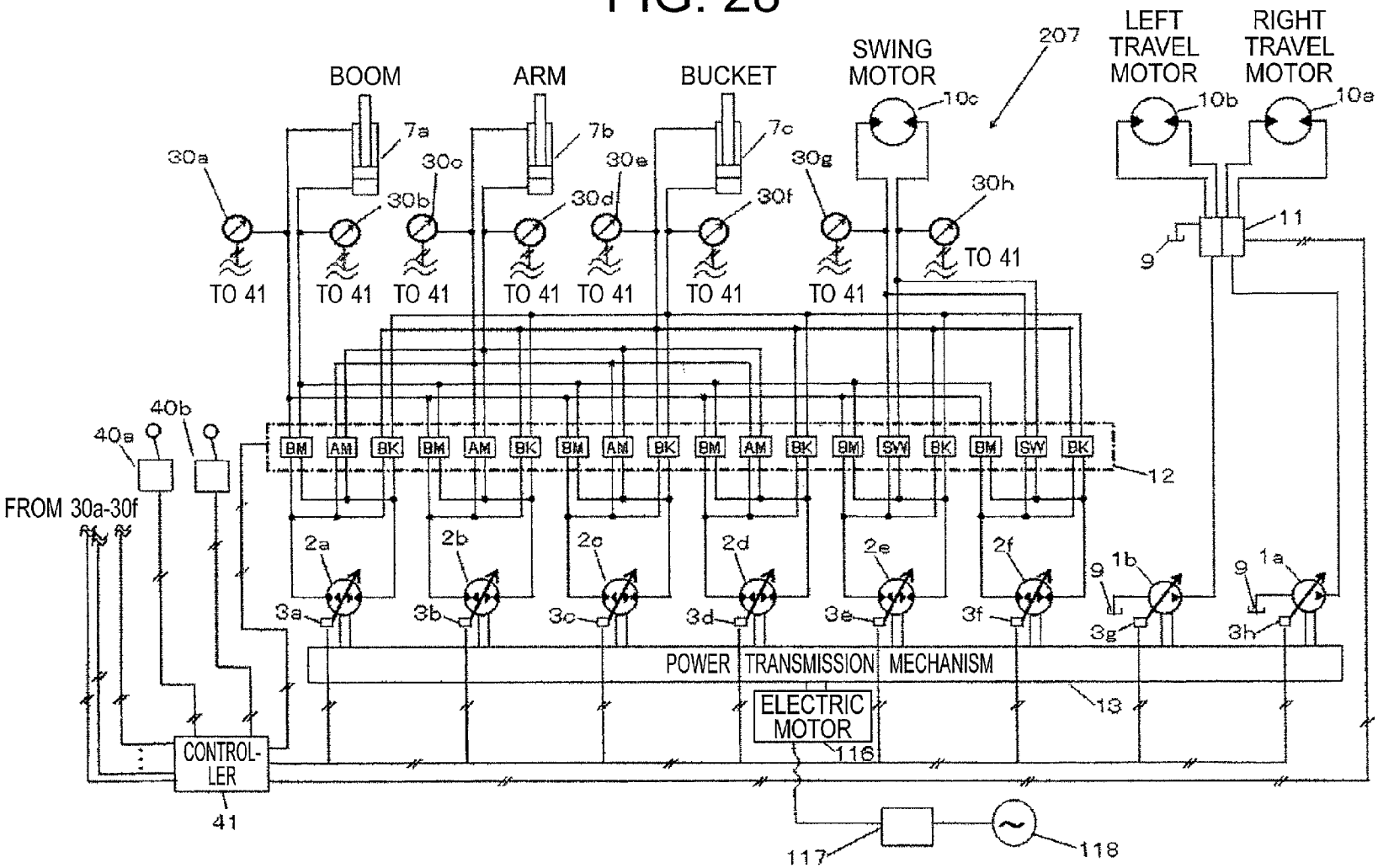
FIG. 28 is a circuit configuration diagram depicting essential parts of a drive system provided in a hydraulic excavator and including a fourth embodiment of the driving device according to the present invention for the working machine.

FIG. 28 is a circuit configuration diagram depicting essential parts of a drive system provided in a hydraulic excavator and including a fourth embodiment of the driving device according to the present invention for the working machine.

A description is omitted about the elements of the same reference numerals as in the first embodiment.

A drive system 207 depicted in FIG. 28 is provided with an electric motor 116 as a prime mover instead of the engine 106 in the first embodiment. Therefore, the electric motor 116 in inputted with electric power from an external power source 118 via a control panel 117. The external power source 118 may be a common commercial power source. The control panel 117 includes an unillustrated breaker, a starter, and is disposed in the upperstructure 102. A drive output from the electric motor 116 is transmitted to the variable displacement hydraulic pumps 2*a*-2*f* via the power transmission mechanism 13.

Figure 29:
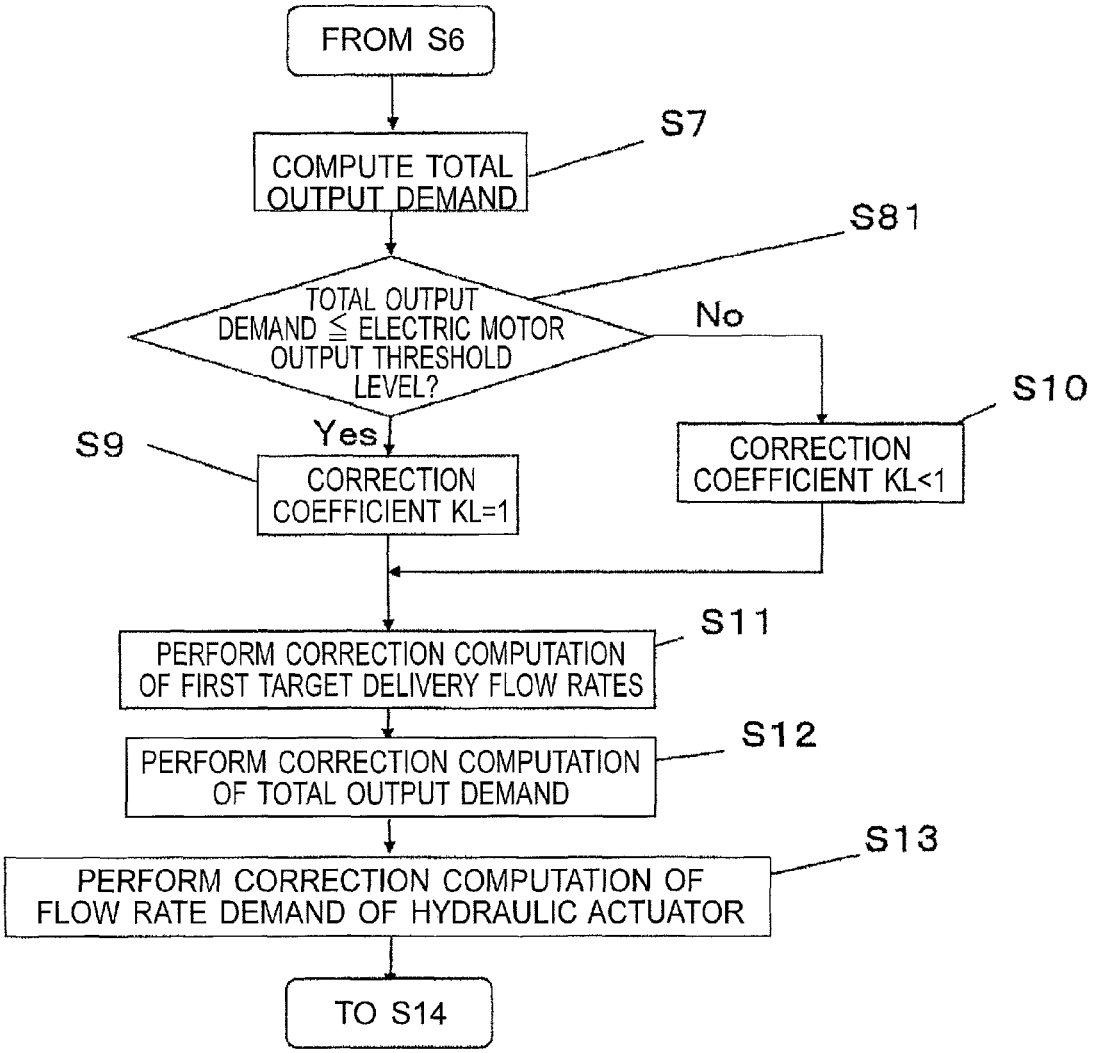
FIG. 29 is a flow chart diagram illustrating a control step at an output limiting unit provided in a controller depicted in FIG. 28.

FIG. 29 is a flow chart diagram illustrating a control step at an output limiting unit 41*c* provided in a controller depicted in FIG. 28.

As illustrated in FIG. 29, a total output demand and a threshold electric motor output value, for example, a rated output are compared in step S81 to determine whether or not a correction is to be made. Except for this determination, the control step is similar to the that in the first embodiment.

Working machines with the electric motor 116, which is described in this embodiment, mounted as a prime mover are widely used, for example, as mining hydraulic excavators and scrap metal processing equipment.

By this embodiment configured as described above, similar effects as those available by the first embodiment can be brought about. It is to be noted that a body frame with the electric motor 116 used thereon can be used not only in the first embodiment but also in the second and third embodiments.

LEGENDS

2*a*~2*f* Variable displacement hydraulic pumps (hydraulic pumps)
3*a*~3*f* Hydraulic regulators (delivery flow rate varying devices)
7*a* Boom cylinder (hydraulic actuator)
7*b* Arm cylinder (hydraulic actuator)
7*c* Bucket cylinder (hydraulic actuator)
10*c* Swing motor (hydraulic actuator)
12 Directional solenoid valves (connection devices)
13 Power transmission mechanism
30*a*~30*h* Pressure sensors (load pressure detection devices)
40*a*,40*b* Control devices
41 Controller (control unit)
41*a* First target delivery-flow-rate setting unit
41*b* Hydraulic pump state amount computing unit
41*c* Output limiting unit
41*d* Second target delivery-flow-rate setting unit
41*e* Hydraulic actuator flow rate demand computing unit
41*f* Connection determining unit
41*g* First target delivery-flow-rate computing unit
41*h* Output demand computing unit
41*i* Prime mover output setting unit
41*j* Output comparison unit
41*k* Correction coefficient computing unit
41*m* State amount correction computing unit
41*n* Selector valve connection command computing unit
41*p* Maximum hydraulic pump capacity storage unit
101 Travel base
102 Upperstructure
103 Working mechanism
104 Cab
106 Engine (prime mover)
107 Drive system
111 Boom
112 Arm
113 Bucket
116 Electric motor (prime mover)
207 Drive system

The invention claimed is:

1. A driving device for a working machine, comprising a prime mover, a plurality of hydraulic pumps to which drive force is fed by the prime mover, delivery flow rate varying devices that vary delivery flow rates of the hydraulic pumps, respectively, a plurality of hydraulic actuators, connection devices that connect desired one of the hydraulic actuators and at least one of the hydraulic pumps through a closed circuit, control devices that generate control signals for the hydraulic actuators, load pressure detection devices that detect load pressures on the hydraulic actuators, and a controller that controls the delivery flow rate varying devices and the connection devices according to the control signal from at least one of the control devices, wherein:

the controller comprises a first target delivery-flow-rate setting unit that computes a first target flow rate of the at least one hydraulic pump, which delivers pressure oil to the desired one hydraulic actuator, according to the control signal from the at least one control device and corresponding one of preset efficiency-setting values for the hydraulic pumps, and the controller further comprises a hydraulic pump state amount computing unit that computes one of an efficiency of the at least one hydraulic pump according to the load pressure of one of the load pressure detection devices for the desired one hydraulic actuator and a delivery flow rate of the at least one hydraulic pump based on the preset efficiency value for the at least one hydraulic pump; an output limiting unit that limits an output demand of the desired one hydraulic actuator according to the first target flow rate calculated by the first target delivery-flow-rate setting unit, the load pressure from the one load pressure detector, the delivery flow rate computed by the hydraulic pump state amount computing unit, and a preset threshold level of output for the prime mover; and a second target delivery-flow-rate setting unit that computes a second target delivery flow rate of the at least one hydraulic pump, which delivers the pressure oil to the desired one hydraulic actuator, according to a computed value from the output limiting unit and the delivery flow rate from the hydraulic pump state amount computing unit.

2. A driving system for a working machine, the driving system comprising:

a prime mover;

a plurality of hydraulic pumps to which drive force is fed by the prime mover;

delivery flow rate varying devices that vary delivery flow rates of the plurality of hydraulic pumps, respectively;

a plurality of hydraulic actuators;

connection devices that connect desired one of the plurality of hydraulic actuators and at least one of the plurality of hydraulic pumps through a closed circuit;

control devices that generate control signals for the plurality of hydraulic actuators;

load pressure detection devices that detect load pressures on the plurality of hydraulic actuators; and a controller that controls the delivery flow rate varying devices and the connection devices according to the control signal from at least one of the control devices, wherein:

the controller comprises a first target delivery-flow-rate setting unit that computes a first target flow rate of the at least one hydraulic pump, which delivers pressure oil to the desired one hydraulic actuator, according to the control signal from the at least one control device and corresponding one of preset efficiency-setting values for the hydraulic pumps, and the controller further comprises a hydraulic pump state amount computing unit that computes one of an efficiency of the at least one hydraulic pump according to the load pressure of one of the load pressure detection devices for the desired one hydraulic actuator and a delivery flow rate of the at least one hydraulic pump based on the preset efficiency value for the at least one hydraulic pump; an output limiting unit that limits an output demand of the desired one hydraulic actuator according to the first target flow rate calculated by the first target delivery-flow-rate setting unit, the load pressure from the one load pressure detector, the delivery flow rate computed by the hydraulic pump state amount computing unit, and a preset threshold level of output for the prime mover; and a second target delivery-flow-rate setting unit that computes a second target delivery flow rate of the at least one hydraulic pump, which delivers the pressure oil to the desired one hydraulic actuator, according to a computed value from the output limiting unit and the delivery flow rate from the hydraulic pump state amount computing unit.

* * * * *